US007708482B2

(12) United States Patent
Koike et al.

(10) Patent No.: US 7,708,482 B2
(45) Date of Patent: May 4, 2010

(54) METHOD FOR CONTROLLING THE OPERATION OF A PRINTER CONNECTED TO AN AUTOMATIC SHEET FEEDER OR ROLL PAPER HOLDER

(75) Inventors: Toshiaki Koike, Shiojiri (JP); Hiroshi Narita, Nagano-ken (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 12/005,739

(22) Filed: Dec. 28, 2007

(65) Prior Publication Data

US 2008/0112747 A1 May 15, 2008

Related U.S. Application Data

(62) Division of application No. 11/254,178, filed on Oct. 18, 2005, now abandoned.

(51) Int. Cl.
*B41J 11/00* (2006.01)

(52) U.S. Cl. ..... 400/605; 400/611; 400/613; 400/624; 400/625; 226/101

(58) Field of Classification Search ..... 400/605, 400/613, 636.2; 226/101
See application file for complete search history.

(56) References Cited

U.S. PATENT DOCUMENTS

| | | | | |
|---|---|---|---|---|
| 4,417,825 | A | 11/1983 | Cushman et al. | |
| 4,498,794 | A | 2/1985 | Waibel | |
| 4,586,834 | A * | 5/1986 | Hachisuga et al. | 400/120.13 |
| 4,619,388 | A | 10/1986 | Ono et al. | |
| 4,671,686 | A | 6/1987 | Howes et al. | |
| 5,033,890 | A | 7/1991 | Niikawa | |
| 5,564,842 | A * | 10/1996 | Kida et al. | 400/185 |
| 5,920,743 | A | 7/1999 | Yamada et al. | |
| 6,203,223 | B1 | 3/2001 | Nakayama et al. | |
| 6,256,119 | B1 | 7/2001 | Isozaki | |
| 6,530,636 | B1 | 3/2003 | Asauchi | |
| 6,586,525 | B1 | 7/2003 | Urata et al. | |

FOREIGN PATENT DOCUMENTS

| | | | |
|---|---|---|---|
| DE | 04719598.7-2304 | | 1/2007 |
| EP | 0 227 116 | A2 | 12/1986 |
| EP | 0 345 018 | | 12/1989 |
| EP | 1 008 545 | | 6/2000 |
| EP | 1 607 230 | A1 | 12/2005 |
| GB | 2 181 392 | A | 10/1986 |
| JP | 01145174 | | 6/1989 |

(Continued)

OTHER PUBLICATIONS

European Search Report which issued in the corresponding European patent application, citing the listed references.

*Primary Examiner*—Ren Yan
*Assistant Examiner*—Matthew G Marini
(74) *Attorney, Agent, or Firm*—Baker & Hostetler, LLP

(57) ABSTRACT

A printer has an ASF connection/disconnection sensor 18*a* as a sheet feeding device detector which detects if an ASF 60 is installed to the main printer unit 1, a roll paper holder connection sensor 38 as a roll paper holder detector which detects if a roll paper holder 40 is installed to the main printer unit 1, and a control circuit board 35 which controls operation of the main printer unit 1 according to the detection status of the ASF connection/disconnection sensor 18*a* and roll paper holder connection sensor 38.

4 Claims, 17 Drawing Sheets

FOREIGN PATENT DOCUMENTS

| | | |
|---|---|---|
| JP | 02-0666046 | 6/1990 |
| JP | 02286527 | 11/1990 |
| JP | 11170637 | 6/1999 |
| JP | 3-153376 | 7/1999 |
| JP | 11-348364 | 12/1999 |
| JP | 2001-80069 | 3/2001 |
| JP | 2002086777 | 3/2002 |
| JP | 2005-505688 | 2/2005 |

* cited by examiner

METHOD FOR CONTROLLING THE OPERATION OF A PRINTER CONNECTED TO AN AUTOMATIC SHEET FEEDER OR ROLL PAPER HOLDER

The present invention is a divisional application of Ser. No. 11/254,178, filed on Oct. 18, 2005 now abandoned and relates to a control method for operating a printer.

BACKGROUND ART

An inkjet printer discharges ink drops on paper using, for example, piezoelectric elements, thermal elements, or electrostatic actuators so that the discharged ink forms images on the paper. A continuous paper holder or automatic sheet feeder (ASF) is also typically attached to the inkjet printer, and the printer conveys roll paper supplied from the continuous paper holder or feeds individual sheets of paper supplied from an automatic sheet feeder in a specific direction to record images on the supplied paper while controlling the transportation of the paper and the discharge of the ink drops on the paper.

An inkjet printer of this general type supplies paper from a paper supply opening rendered at the back of the printer case (housing) to a paper transportation path and, at the same time, discharges ink drops on the paper from an ink head disposed to a carriage at a specific position on the paper. The paper is discharged from a paper exit rendered at the front of the housing.

The roll paper holder or ASF (automatic sheet feeder) can be freely installed to and removed from some inkjet printers built so that the roll paper holder or ASF (automatic sheet feeder) can be installed appropriately to the printer for carrying out a desired printing application. An inkjet printer of this type is taught and described in Japanese Unexamined Patent Appl. Pub. H 11-348364 (FIG. 1). This inkjet printer requires the user to recognize whether the roll paper holder or the ASF is installed to the printer for the printer to operate properly. To do so requires changing the setup which increases the burden on the user and is bothersome. In addition, the user must also load the appropriate paper into the paper transportation path according to whether the roll paper holder is installed, the ASF is installed, or if neither is installed. If the paper is mistakenly loaded problems can occur as different types of paper may collide inside the paper transportation path.

DISCLOSURE OF INVENTION

In view of the foregoing problem, an object of the present invention is to provide a control method for operating a printer that will electronically recognize whether the roll paper holder is installed, the ASF is installed, or if neither is installed and will control the operation of the printer based upon such recognition to reduce the burden on the user.

(1) A control method for operating a printer (1) comprising the steps of: detecting if the roll paper holder is installed to the printer when power to the printer is turned on, and if so: detecting when a paper transportation path in the printer is in a closed position; detecting a leading end and a trailing end of paper in the paper transportation path; and discharging the paper from the paper transportation path when only the leading end of the paper is detected.

(2) A control method for operating the printer (1) comprising the steps of: detecting if the roll paper holder is installed to the printer when power to the printer is turned on, and if so: detecting when the paper transportation path is in a closed position; detecting a leading end and a trailing end of paper in the paper transportation path; and indexing the paper in the paper transportation path when only the trailing end of the paper is detected.

(3) A control method for operating the printer (1) comprising the steps of: detecting if the ASF is installed to the printer when power to the printer is turned on, and if so: detecting when the paper transportation path is in a closed position; detecting a leading end and a trailing end of paper in the paper transportation path; and discharging the paper from the paper transportation path when either the leading end or the trailing end of the paper is detected.

(4) A control method for operating the printer (1) comprising the steps of: detecting if the paper transportation path is in a closed position during manual printer operation, and if so: detecting a leading end and a trailing end of paper in the paper transportation path; and indexing the paper in the paper transportation path when both the leading end and the trailing end of the paper are detected.

(5) A control method for operating the printer (1) comprising the steps of: detecting if the paper transportation path is in a closed position when paper is supplied from the ASF, and if so: detecting a leading end and a trailing end of paper in the paper transportation path before paper is supplied from the ASF; and discharging the paper from the paper transportation path when either the leading end or the trailing end of the paper is detected.

BEST MODE FOR CARRYING OUT THE INVENTION

A preferred embodiment of an inkjet printer according to the present invention is hereafter described with reference to the accompanying figures.

Figure 5:
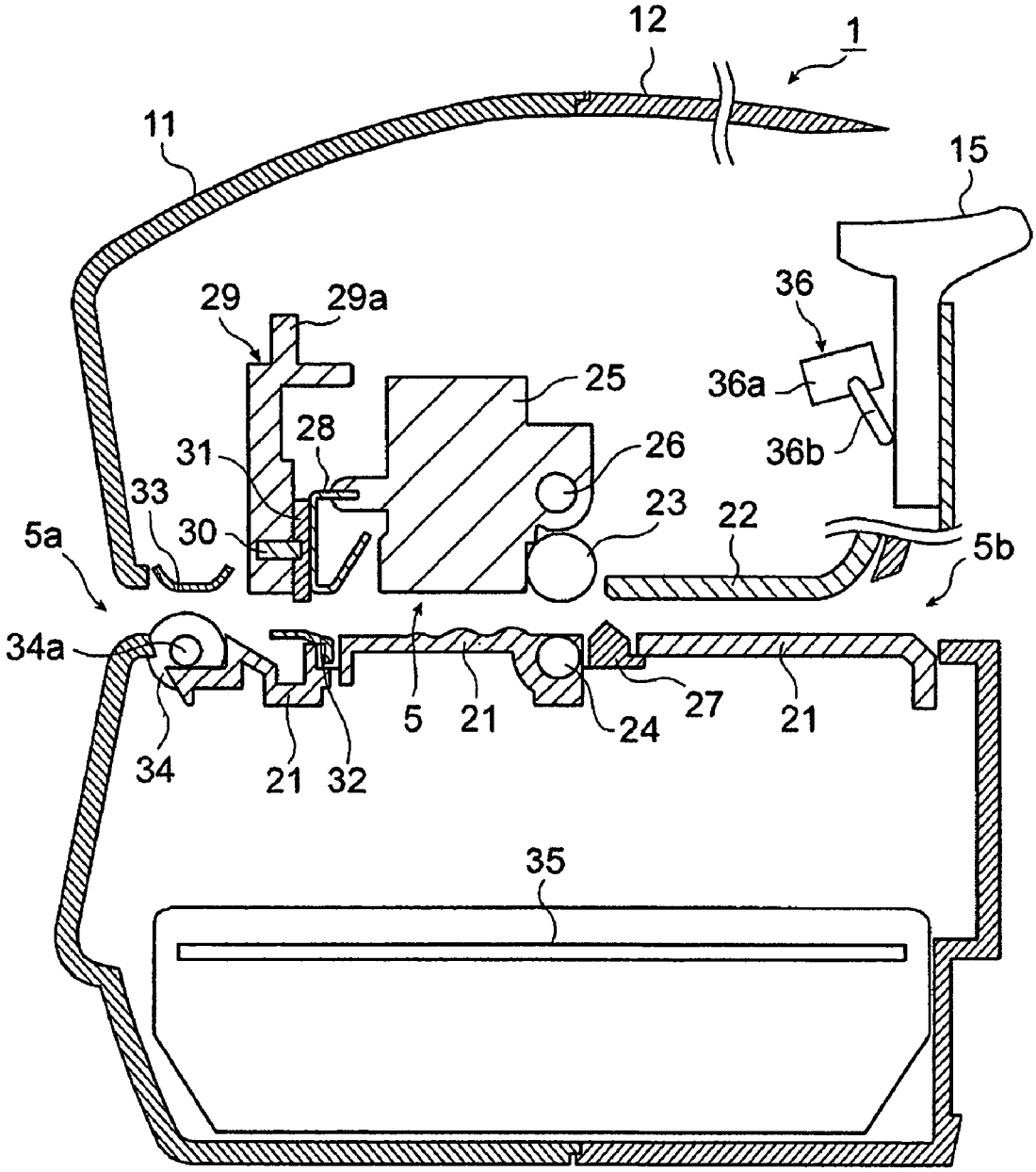
FIG. 5 is a section view showing the paper transportation path when the parts constituting the bottom surface of the paper transportation path are lowered.
Figure 6:
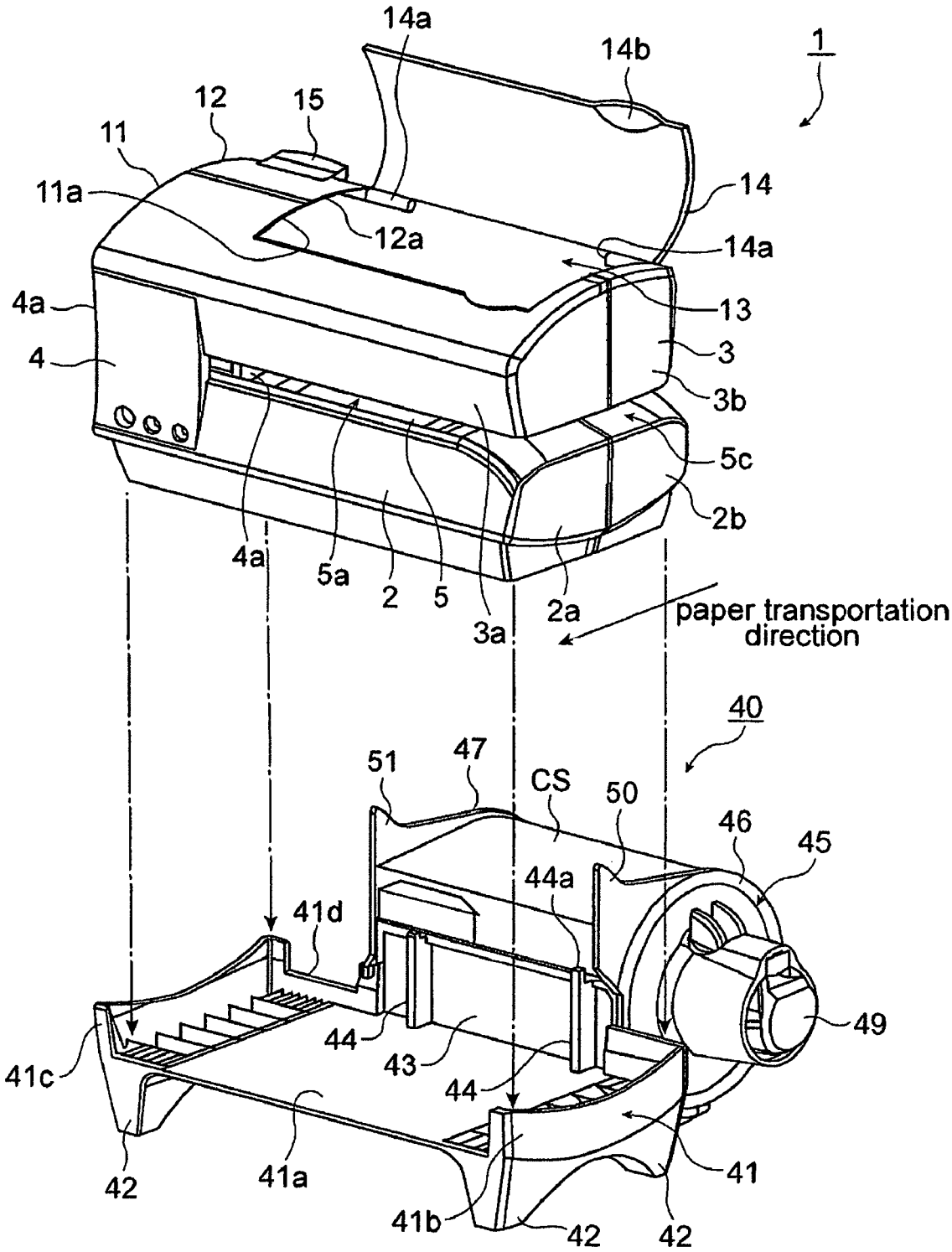
FIG. 6 is an oblique view from the front showing how the roll paper holder is attached to the main printer unit.
Figure 7:
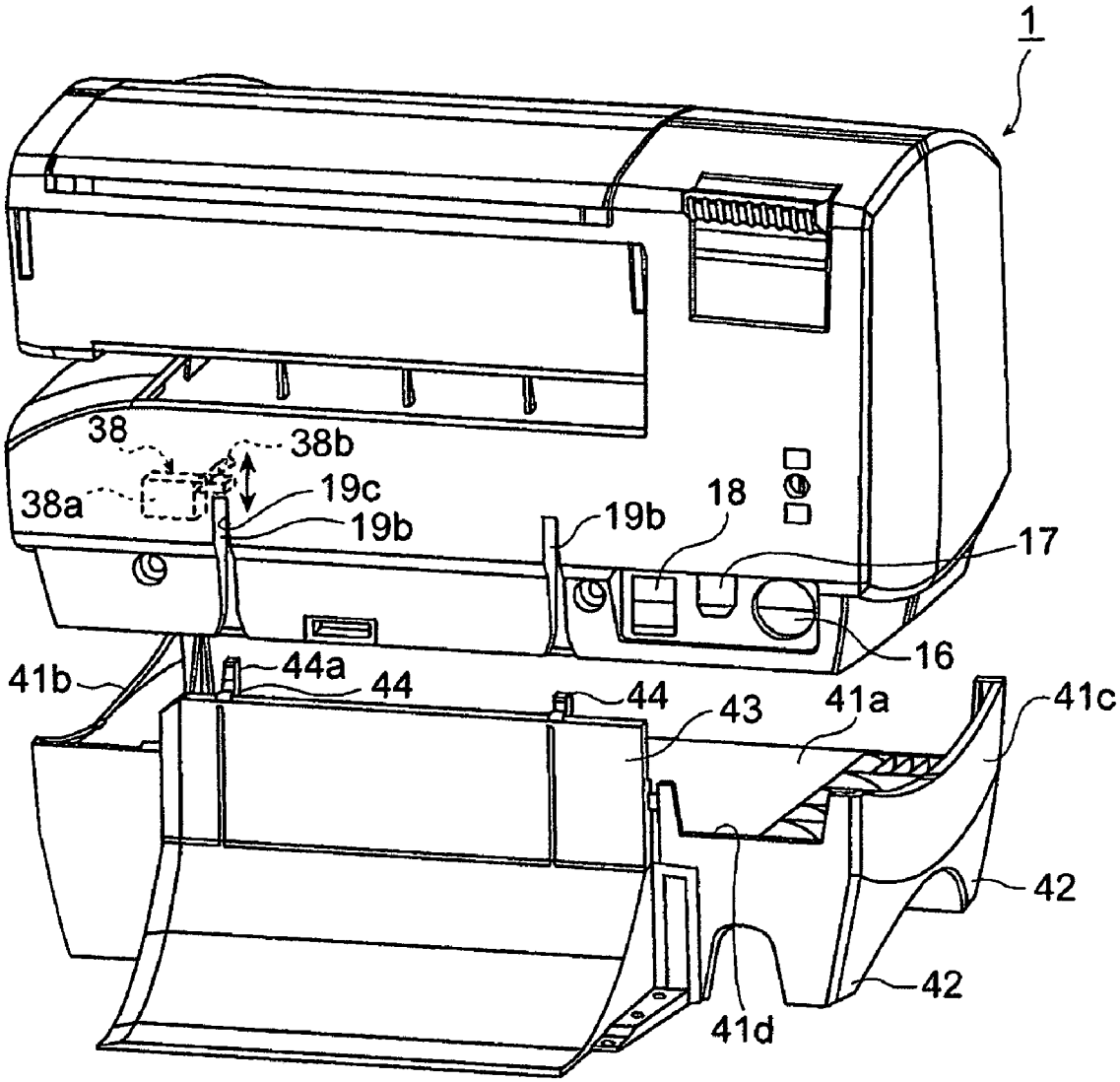
FIG. 7 is an oblique view from the back showing how the roll paper holder is attached to the main printer unit.
Figure 8:
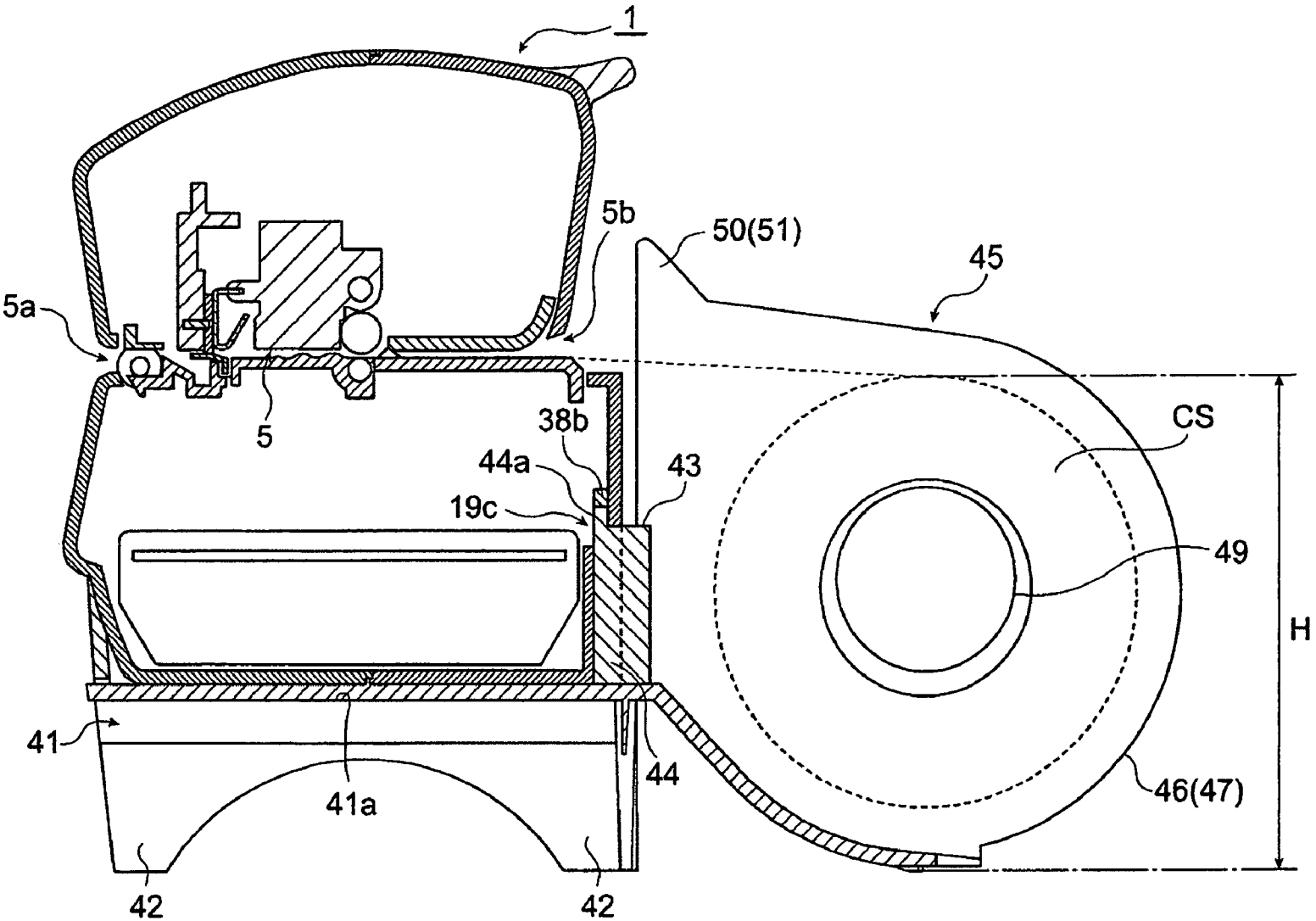
FIG. 8 is a section view showing the roll paper holder attached to the main printer unit.
Figure 9:
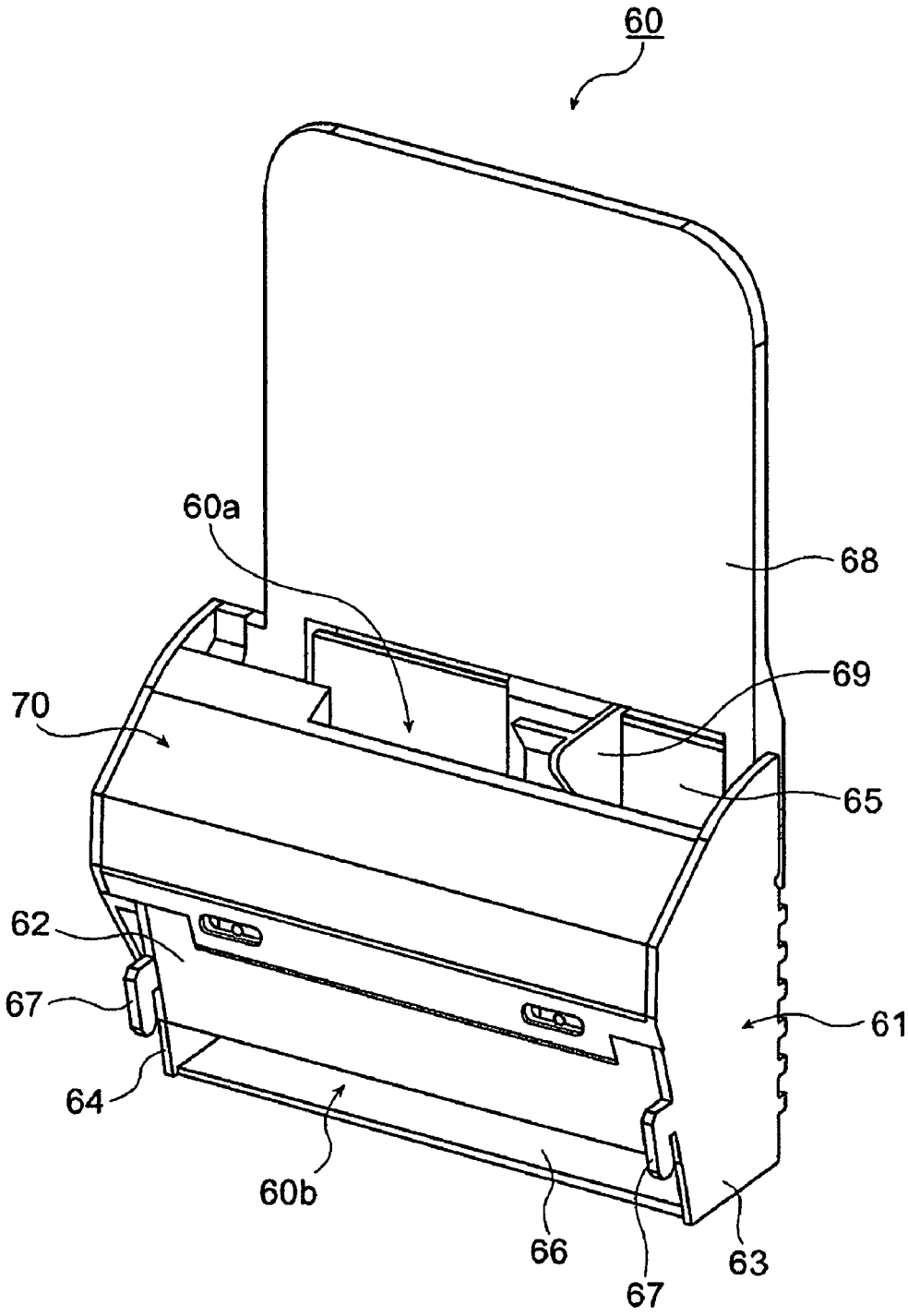
FIG. 9 is an oblique view showing an ASF which can be attached to the main printer unit.
Figure 10:
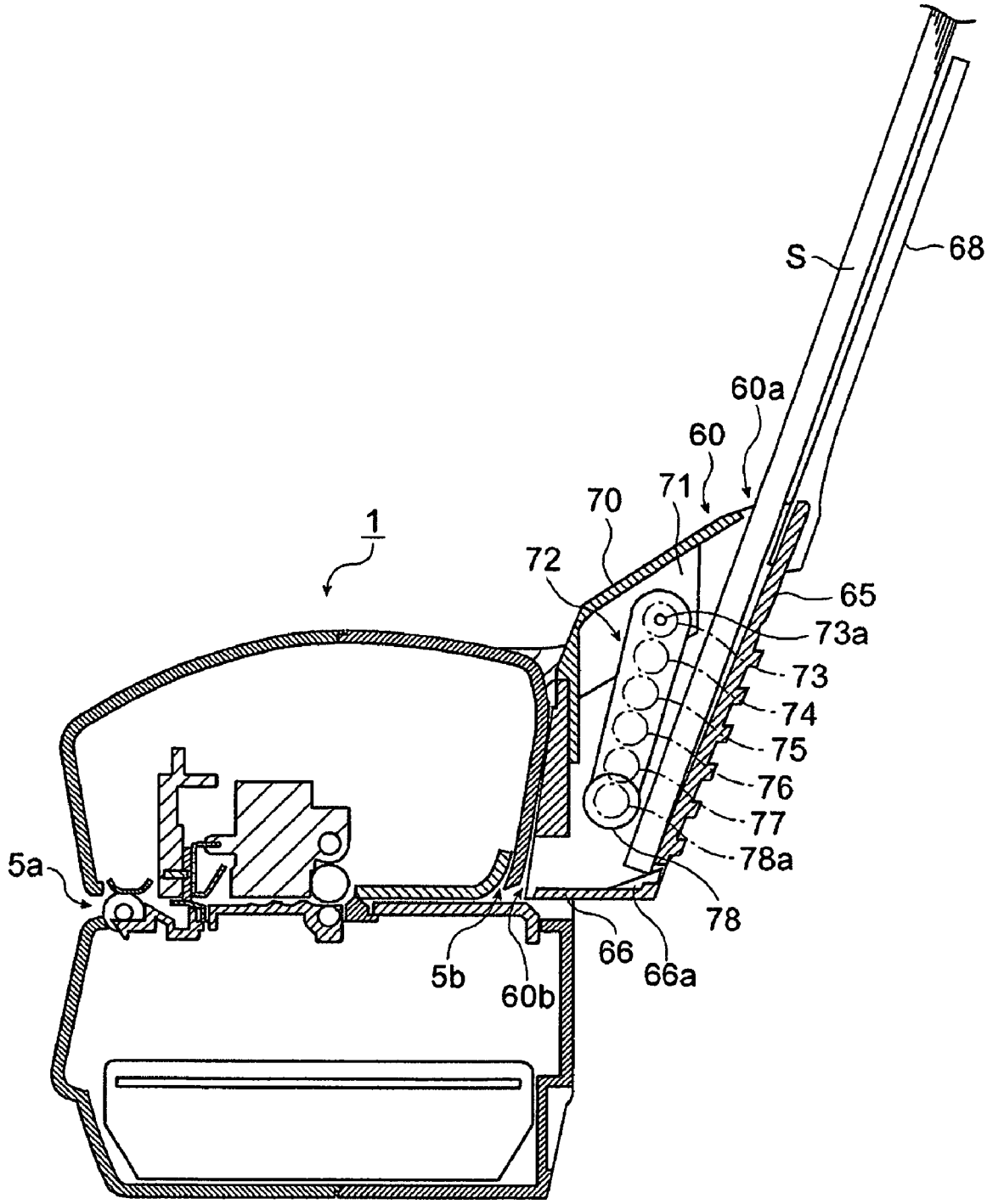
FIG. 10 shows the ASF attached to the main printer unit.

The inkjet printer according to this embodiment of the invention has a main printer unit 1 (shown in FIG. 1 to FIG. 5) to which a continuous paper holder (referred to hereafter as a "roll paper holder") 40 as is shown in FIG. 6 to FIG. 8 and a slip supply apparatus (referred to hereafter as a "ASF") 60 as shown in see FIG. 9 and FIG. 10 may individually but not in combination be removably attached to the main printer unit 1.

The general external arrangement of the main printer unit 1 in this embodiment of the invention includes an image recording unit 3 supported in a cantilevered manner at one end of a base unit 2 by way of an intervening cantilever unit 4. A paper transportation path 5 for conveying paper from the back side to the front side is rendered between the base unit 2 and image recording unit 3.

The paper transportation path 5 has a front opening 5*a*, a back opening 5*b*, and a contiguous side opening 5*c*. Paper inserted to the paper transportation path 5 is conveyed in the direction from the back opening 5*b* side to the front opening 5*a* side (referred to below as the "paper transportation direction"). In a main printer unit 1 according to this embodiment of the invention paper can be inserted to the paper transportation path 5 from any one of these openings, that is, the front opening 5*a*, back opening 5*b*, or side opening 5*c*.

More specifically, paper can be inserted to the paper transportation path in the main printer unit 1 of the present embodiment not only from the back but also from the front and side. More particularly, paper can be manually inserted to the paper transportation path 5 of the main printer unit 1 for printing from a direction substantially perpendicular to the paper transportation direction through the side opening 5*c*. In other words, the main printer unit 1 is arranged so that paper can be inserted through the side opening 5*c* to the paper transportation path 5 from a direction parallel to the paper transportation surface that functions as the paper transportation path 5 between the base unit 2 and image recording unit 3.

Figure 1:
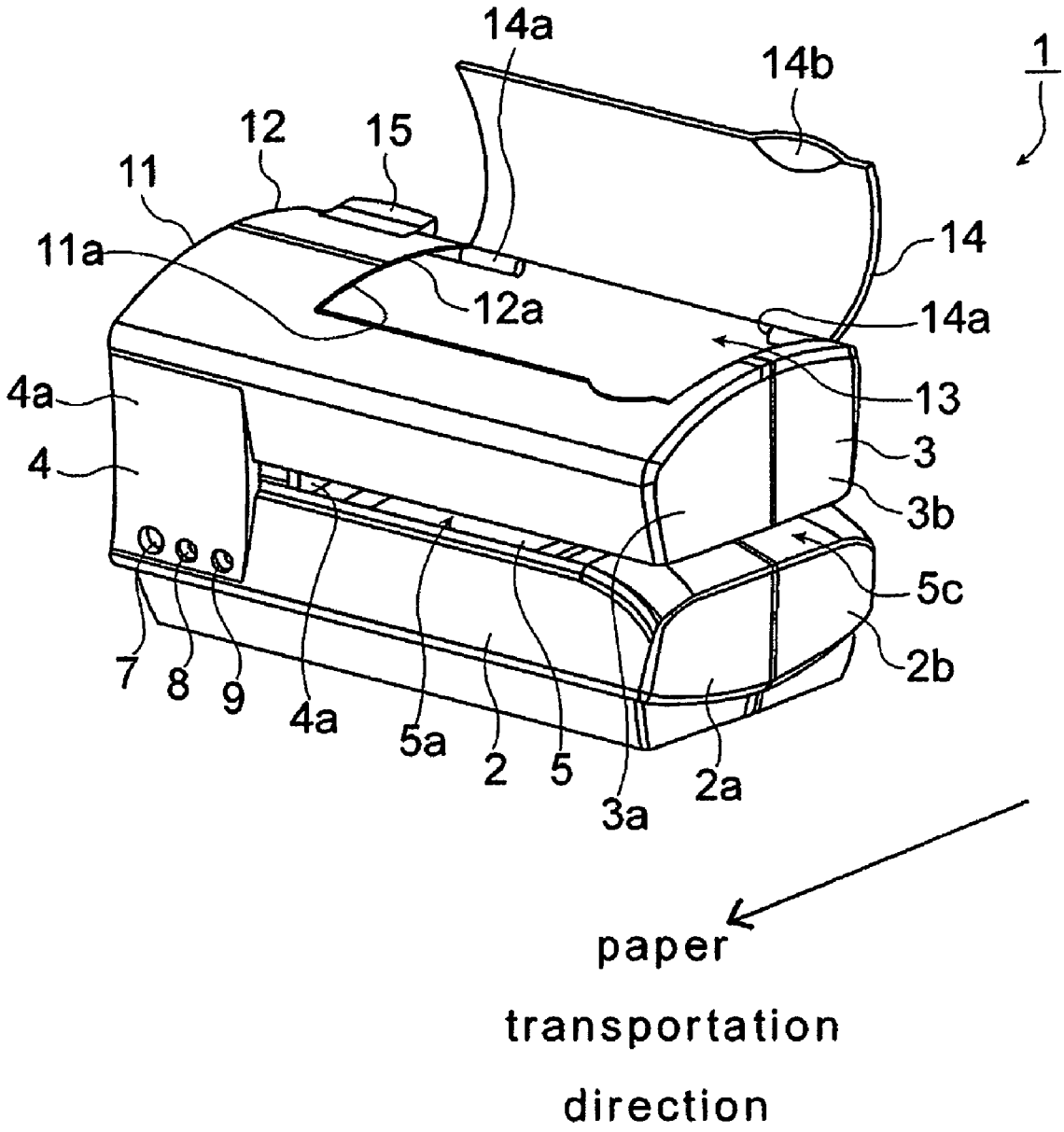
FIG. 1 is an oblique view from the front of the main printer unit of an inkjet printer according to a preferred embodiment of the invention.

The outside walls of the base unit 2, image recording unit 3, and cantilever unit 4 are formed by fitting a front case 11 and a back case 12 together with the front case 11 composed of a base unit front case 2*a*, cantilever unit front case 4*a*, and image recording unit front case 3*a* integrally formed in a roughly U-shaped arrangement, and the back case 12 composed of a base unit back case 2*b*, cantilever unit back case 4*b*, and image recording unit back case 3*b* integrally formed in a roughly U-shaped arrangement. As shown in FIG. 1, an opening 13 composed of opposing U-shaped cut-outs 11*a* and 12*a* is formed in the top of image recording unit front case 3*a* and image recording unit back case 3*b*.

Figure 2:
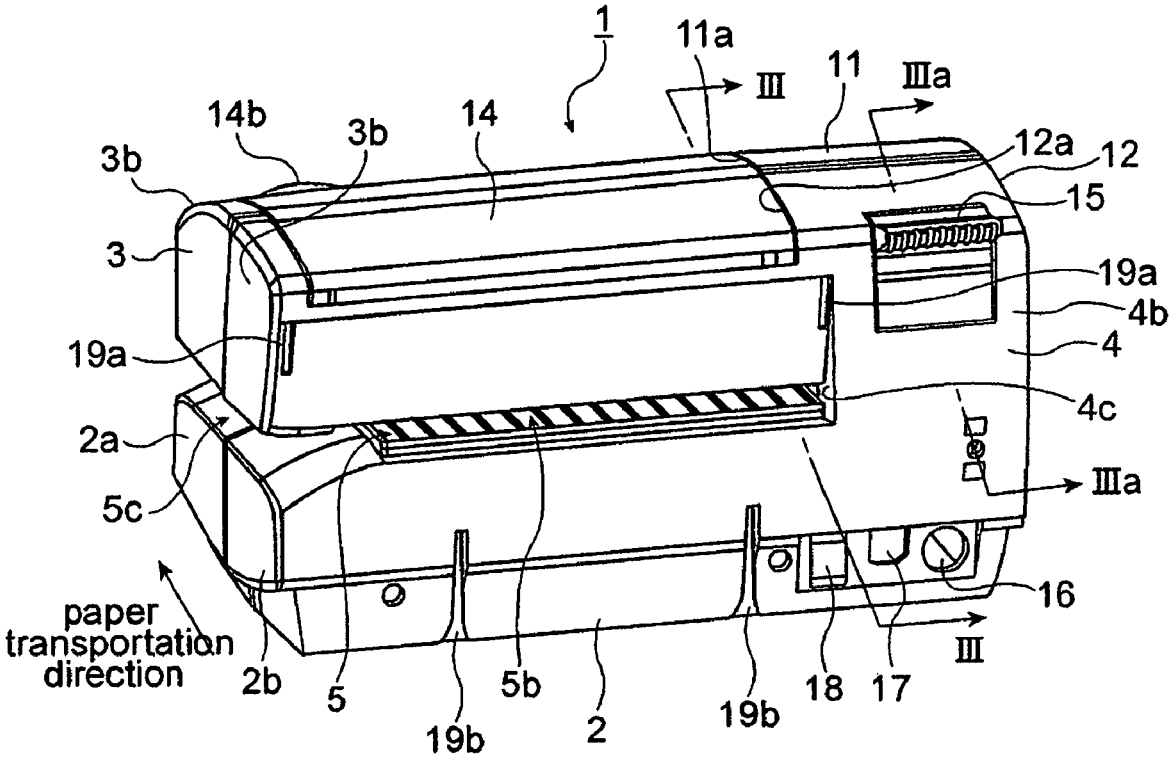
FIG. 2 is an oblique view from the back of the main printer unit.

A cover 14 is openably and closably attached via a hinge 14*a* to the edge portion of cut-out 12*a* in the image recording unit back case 3*b*. This cover 14 is attached so that it covers the opening 13 when closed as shown in FIG. 2. By thus covering the opening 13, cover 14 protects the internal components (not shown in FIG. 1) of the image recording unit 3 from the outside of the main printer unit 1. A protruding tab 14*b* for opening and closing the cover is disposed to the cover 14 on the edge on the opposite side as the side on which the hinge 14*a* is formed. This protruding tab 14*b* is formed so that the user can easily catch the tab 14*b* with a finger to open the cover 14. The user can access the internal components of the image recording unit 3 for maintenance when the cover 14 is open as shown in FIG. 1 so that, for example, an ink cartridge removably installed to the carriage 25 described below can be replaced.

A release lever 15 is further disposed to the cantilever unit back case 4*b*. This release lever 15 is rendered so that the release lever 15 can be pushed down and the platen 21 (see FIG. 3) forming part of the paper transportation path 5 as described below moves up and down in conjunction with other parts attached to the platen 21 when the release lever 15 is operated so that paper can be inserted to the paper transportation path 5. Operation of the release lever 15 is described in further detail below.

A power cable connector 16 to which a cable connected to an external power source is connected to supply power for driving the printer, a data communication terminal 17 to which is connected a USB cable, for example, for data communication between the printer and a personal computer or other host computer, and an ASF drive cable connector 18 to which is connected a power cable for supplying power to the ASF (automatic sheet feeder) 60 described below, are disposed to a portion of the base unit back case 2*b* below the cantilever unit 4.

A cable connection confirmation pin (not shown in the figure) for confirming whether a cable for supplying power to the ASF 60 is connected is also disposed to the ASF drive cable connector 18. The main printer unit 1 determines whether the ASF 60 described below is connected from the cable connection confirmation pin, which is shorted when a cable is connected to the ASF drive cable connector 18. The cable connection confirmation pin of the ASF drive cable connector 18 thus also functions as an ASF connection/disconnection sensor 18*a* for determining whether the ASF 60 is installed (see FIG. 11).

As also shown in FIG. 2, slots 19*a* for attaching the ASF 60 are formed on the back of the image recording unit back case 3*b*. In addition, slots 19*b* for attaching the roll paper holder 40 described below are formed in the back of the base unit back case 2*b*. Attaching the roll paper holder 40 and ASF 60 is described further below.

A power switch 7, cleaning button 8, and paper feed button 9 are rendered on the front of the cantilever unit front case 4*a* as shown in FIG. 1.

The power switch 7 turns the power to the main printer unit 1 on and off. Pressing the power switch 7 when the power cable connected to an external power source is inserted to the power cable connector 16 causes the main printer unit 1 to start and begin the initialization process. Pressing the power switch 7 again when the power is on interrupts the power supply to the main printer unit 1 and turns the power off.

An LED or other lamp (not shown in the figure) is disposed behind the power switch 7. The power switch 7 is made from an optically transparent plastic material so that this lamp can be seen through the power switch 7 when the lamp is on. This lamp turns on when the power switch 7 is on in this embodiment of the invention, thus enabling the user to visually confirm that the main printer unit 1 power is on.

The cleaning button 8 is used for cleaning the head of the main printer unit 1. Pressing the cleaning button 8 causes a cleaning means not shown to clean the head of the main printer unit 1 as described further below. The cleaning system could also be arranged so that pressing the cleaning button 8 when the ASF 60 is installed also causes the supply roller 78 of the ASF 60 to be cleaned at the same time.

As with the power switch 7, an LED or other lamp (not shown in the figure) is disposed behind the cleaning button 8. The cleaning button 8 is made from an optically transparent plastic material so that the lamp can be seen through the cleaning button 8 when the lamp is on. This lamp can be designed to start flashing after a specified period of time has passed so that, for example, the user can know from the flashing lamp that cleaning is needed and the flashing indicator causes the user to press the cleaning button 8.

The paper feed button 9 is used to feed paper from the ASF 60 described below into the paper transportation path 5 of the main printer unit 1. Paper is normally fed automatically when a page break command is received to start printing, but the paper may not be fed for various reasons. In such circumstances the user can press the paper feed button 9 to feed paper into the paper transportation path 5 of the main printer unit 1.

As with the power switch 7, an LED or other lamp (not shown in the figure) is disposed behind the paper feed button 9. The paper feed button 9 is made from an optically transparent plastic material so that the lamp can be seen through the paper feed button 9 when the lamp is on. This lamp can be designed to start flashing when the ASF 60 fails to automatically feed paper, for example. The user can thus know from seeing the flashing indicator that the ASF 60 failed to automatically feed paper into the paper transportation path 5, press the paper feed button 9 after confirming why the paper failed to feed, and thus cause the ASF 60 to attempt supplying paper again.

(Internal Structure of the Main Printer Unit)

Figure 3:
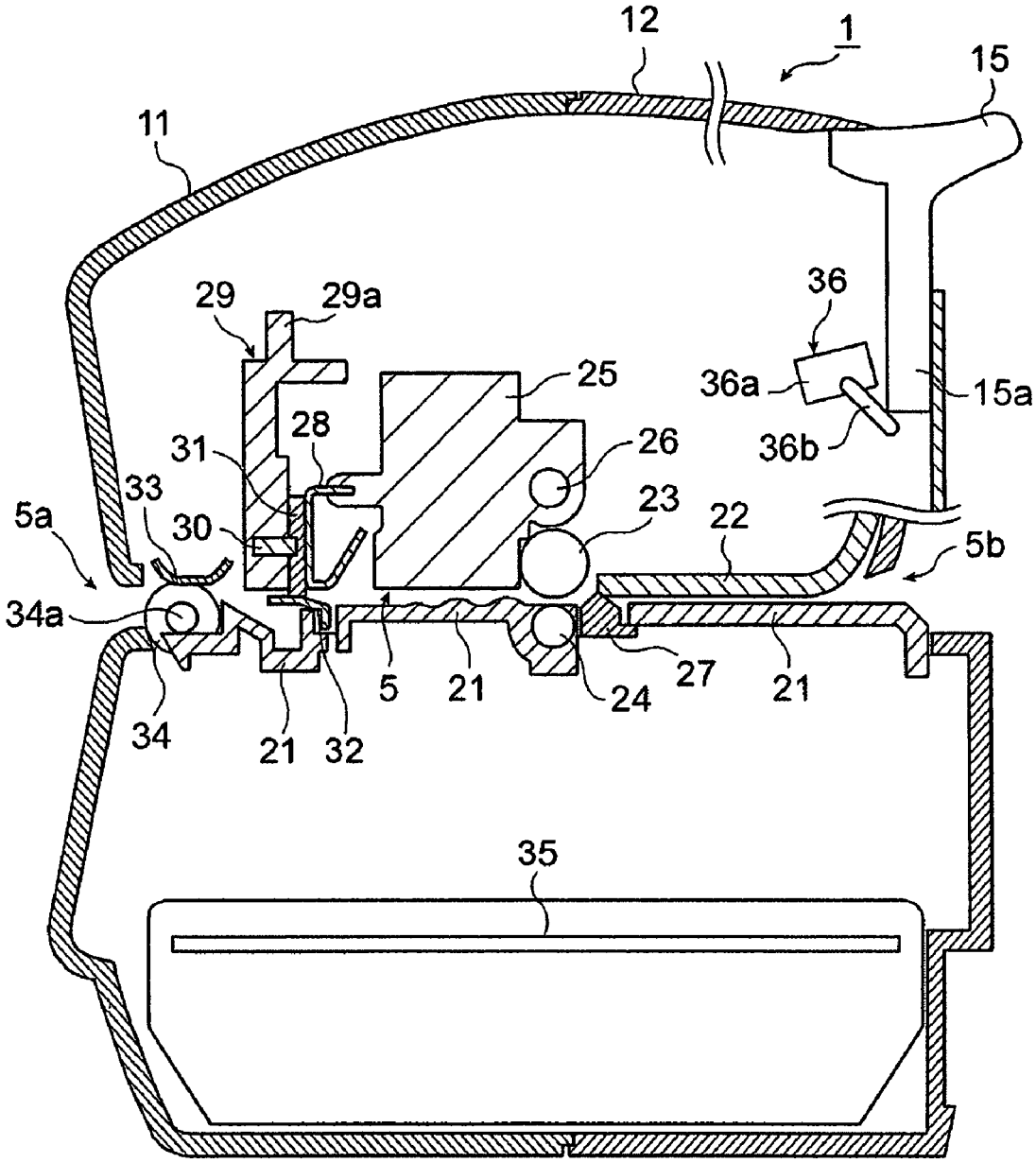
FIG. 3 is a section view through line III-III in FIG. 2.
Figure 4:
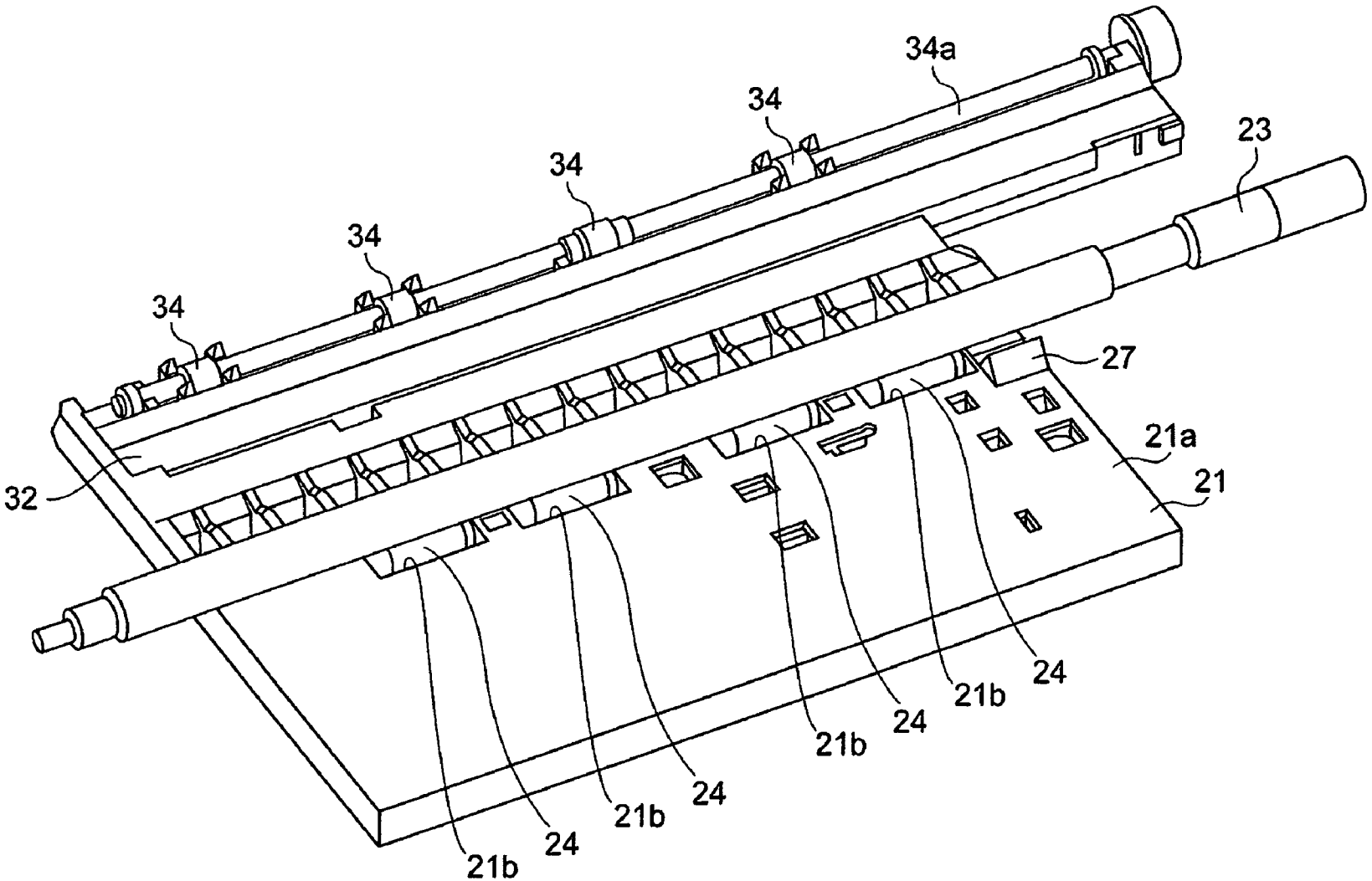
FIG. 4 is an oblique view showing the arrangement in the proximity of the paper transportation path.

FIG. 3 is a section view through line III-III and line IIIa-IIIa in FIG. 2 showing the major components of the internal structure of the main printer unit 1. FIG. 4 is an oblique view showing the arrangement around the paper transportation path, and FIG. 5 is a section view showing the parts constituting the bottom surface of the paper transportation path in the lowered position.

A platen 21 constitutes the major part of the bottom surface of the paper transportation path 5 from the back opening 5*b* to the front opening 5*a*. The platen 21 is a plate-like member forming the top surface of the base unit 2, and the top surface 21*a* thereof is substantially flat as shown in FIG. 4. Disposed to the top of the paper transportation path 5 opposite the platen 21 in order from the upstream side are a paper guide 22, main paper transportation roller 23, carriage 25, automatic paper cutter 29, and TOF lever 33. A control circuit board 35 is located below the platen 21. These components are further described below as they relate to the platen 21.

The paper guide 22 is disposed opposite the platen 21 on the upstream side of the paper transportation path 5. The paper guide 22 forms a convexly curving surface on the side facing the paper transportation path 5 so that paper supplied from the back opening 5*b* is inserted smoothly to the paper transportation path 5. Paper inserted from the back opening 5*b* is conveyed between the platen 21 and paper guide 22 to the main paper transportation roller 23.

Multiple recessed portions 21*b* are formed at approximately the middle of the platen 21 in the paper transportation direction. A paper feed roller 24 is rotatably disposed in each of these recessed portions 21*b*. The paper feed rollers 24 are located opposite the main paper transportation roller 23 located thereabove, and thus follow rotation of the main paper transportation roller 23, which is driven by a motor not shown. The paper is nipped between the main paper transportation roller 23 and paper feed rollers 24, and can thus be conveyed in the paper transportation direction or the opposite direction.

A BOF lever 27 is disposed to the platen 21 near the main paper transportation roller 23. This BOF lever 27 is a part of the paper trailing-end detector, and is arranged so that conveying paper over the platen pushes the BOF lever 27 down. This depression of the BOF lever 27 is sensed by a BOF sensor 27*a* (see FIG. 11) which is composed of an optical sensor and linkage mechanism formed integrally to the BOF lever 27, for example. This BOF sensor 27*a* detects a state change in the BOF lever 27 and outputs a signal to the control circuit board 35. As a result, the paper is known to be above the BOF lever 27. This BOF sensor 27*a* also senses the timing at which the BOF lever 27 returns to the previous state, and outputs a signal to the control circuit board 35. That the paper is not above the BOF lever 27 can thus be determined.

The carriage 25 is disposed opposite the platen 21 on the downstream side of the main paper transportation roller 23. The carriage 25 is supported by a guide plate 28 and guide shaft 26 extending lengthwise along the direction (perpendicular to the paper transportation path 5, that is, widthwise to the paper) joining the paper transportation path 5 side 4*c* of the cantilever unit 4 and the side opening 5*c*. The carriage 25 can thus slide freely along the guide shaft 26 and guide plate 28 perpendicularly to the paper transportation path 5.

The carriage 25 carries an inkjet head (not shown in the figure) having a plurality of nozzles for discharging ink to the paper disposed facing the platen 21. Images are recorded on paper positioned on the platen 21 by discharging ink from plural nozzles of the ink head while the carriage 25 travels along the guide shaft 26. An ink cartridge (not shown in the figure) for supplying ink to the ink head is also removably installed to the carriage 25.

An automatic paper cutter 29 is disposed on the downstream side of the carriage 25. The automatic paper cutter 29 is composed of a cutter guide 29*a* which is slidably fixed on the image recording unit 3 side, and a disk-shaped rotating cutter blade 31 rotatably axially supported by a rotating shaft 30 on the cutter guide 29*a* between the cutter guide 29*a* and guide plate 28. The rotating cutter blade 31 is located opposite a stationary cutter blade 32 disposed to the platen 21. The automatic paper cutter 29 cuts roll paper positioned over the stationary cutter blade 32 by moving widthwise to the paper in conjunction with the cutter guide 29*a* while pressing the rotating cutter blade 31 against the stationary cutter blade 32.

Paper transportation subrollers 34 are located near the front opening 5*a* on the downstream side of the automatic paper cutter 29. The paper transportation subrollers 34 are rotatably axially supported on the platen 21 by means of rotary shaft 34*a*. The paper transportation subrollers 34 are opposite a paper transportation subroller guide not shown, and thus convey paper in the paper transportation direction or the opposite direction with the paper nipped between the paper transportation subrollers 34 and this paper transportation subroller guide. The paper conveyed in the paper transportation direction by the paper transportation subrollers 34 is discharged from the front opening 5*a*.

The TOF lever 33 is disposed to the paper transportation subroller guide not shown. This TOF lever 33 is a part of a paper leading-edge detector, and is disposed so that paper passing below the TOF lever 33 pushes the TOF lever 33 up. This raising of the TOF lever 33 is sensed by a TOF sensor 33*a* (see FIG. 11) which is composed of an optical sensor and linkage mechanism formed integrally to the TOF lever 33, for example. This TOF sensor 33*a* detects a state change in the TOF lever 33 and outputs a signal to the control circuit board 35. As a result, the paper is known to be below the TOF lever 33. This TOF sensor 33*a* also senses the timing at which the TOF lever 33 returns to the previous state, and outputs a signal to the control circuit board 35. That the paper is not below the TOF lever 33 can thus be determined.

The control circuit board 35 disposed below the platen 21 is populated with a control chip for centrally controlling the operation of other parts of the main printer unit 1, and memory chips for temporarily storing print commands and print data received through the command data communication terminal 17 from an external source. Detection signals from the TOF sensor, BOF sensor, ASF connection sensor, and a roll paper holder connection sensor 38 described below are sent to the control circuit board 35 for determining the position of the paper and whether the ASF 60 and roll paper holder 40 are installed. The specific arrangement of the control circuit board 35 is further described below.

When the release lever 15 is pushed down to the open position, the platen 21 and the parts attached to the platen 21 are also displaced downward as shown in FIG. 5. Displacing the platen 21 downward vertically opens the paper transportation path 5 so that slips can be manually inserted or roll paper can be loaded. The platen 21 returns to the position shown in FIG. 3 when the release lever 15 is returned to the original closed position, thus preventing manual insertion of slips and inserting roll paper.

As shown in FIG. 3 and FIG. 5, the release lever 15 is disposed so that the distal end of the operating portion 15*a* housed inside the back case 12 can contact release lever sensor 36. This release lever sensor 36 is composed of, for example, a sensor unit 36*a* and a detection lever 36*b* that is installed pivoting on the sensor unit 36*a*. When the release lever 15 is pushed down, the operating portion 15*a* of the release lever 15 pushes down against the detection lever 36*b*, thus causing the detection lever 36*b* to swing. The sensor unit 36*a* detects this pivoting motion of the detection lever 36*b* and outputs to the control circuit board 35. The control unit of the control circuit board 35 thus knows that the release lever 15 was pushed down, that is, that the paper transportation path 5 was opened. In this state the release lever 15 is said herein to be in the open position.

When the release lever 15 is then returned from this depressed position to the original position, the detection lever 36*b* also swings back to its original position in conjunction with the movement of the operating portion 15*a* of the release lever 15. The sensor unit 36*a* detects this circular movement of the detection lever 36*b* and outputs to the control circuit board 35. The control unit of the control circuit board 35 thus knows that the release lever 15 returned to the original position, that is, that the paper transportation path 5 closed. In this state the release lever 15 is said herein to be in the closed position.

As described above, printing to manually inserted paper is possible using only the main printer unit 1. When printing to manually inserted forms, the user can insert paper to the paper transportation path 5 inside the main printer unit 1 from any of the front opening 5*a*, back opening 5*b*, and side opening 5*c* to print images without worrying about the paper size.

More particularly, when using the main printer unit 1 alone, images can be printed with no concern for the shape of the part of the paper that is not inserted into the paper transportation path 5. This enables inserting only one of multiple pages bound at one edge, such as in a book or notebook, to the paper transportation path 5 so that an image can be printed to just that one page. Specialized printing applications, such as printing an image on only one page or each page in a bound notebook, can thus be easily accommodated.

(Roll Paper Holder)

FIG. 6 is an oblique view showing installing a roll paper holder 40 to the main printer unit 1 as seen from the front, FIG. 7 is an oblique view showing installing a roll paper holder 40 to the main printer unit 1 as seen from the back, and FIG. 8 is a section view showing the roll paper holder 40 installed to the main printer unit 1.

The roll paper holder 40 is configured for installation as a first attachment to the main printer unit 1 in this embodiment of the invention. The roll paper holder 40 and installation thereof are described next below.

The roll paper holder 40 is a part for supplying roll paper CS to the main printer unit 1 as continuous paper. The roll paper holder 40 is composed of main printer unit base 41 and a roll paper holding unit 45 attached in unison with the main printer unit base 41.

The main printer unit base 41 is a base in which the base unit 2 of the main printer unit 1 fits, and is composed of a platform 41*a* which conforms to the shape of the bottom of the main printer unit 1 and is substantially rectangular when seen in plan view, four leg portions 42 formed in unison with the four corners of the platform 41*a*, and side guide walls 41*b*, 41*c* rising vertically from the widthwise end portions of the platform 41*a*. A portion of guide wall 41*b* curves from the widthwise end portion of the platform 41*a*, and another portion of the guide wall 41*b* extends between the front edge and the back edge of the platform 41*a*. The base unit 2 of the main printer unit 1 fits inside these guide walls 41*b*, 41*c* and is thus stationed on the platform 41*a*. The bottom of the main printer unit 1 is thus raised by the main printer unit base 41 and the height of the paper transportation path 5 (the height from the installation surface) is thus higher than when the roll paper holder 40 is not installed.

Notch 41*d* is also formed in a portion of the guide wall 41*b* extending to the back-side edge of the platform 41*a* as shown in FIG. 7 so that the power cable connector 16 and data communication terminal 17 disposed to the main printer unit 1 are not covered by the guide wall 41*b*. A power supply cable and USB cable can thus be connected through this notch 41*d* to the power cable connector 16 and data communication terminal 17 while the main printer unit 1 is stationed on the main printer unit base 41. Because the ASF 60 described below cannot be installed when the roll paper holder 40 is installed, the ASF drive cable connector 18 is covered by the guide wall 41*b* in this embodiment.

Back guide wall 43 rises from the platform 41*a* at the back edge of the platform 41*a*. Positioning ribs 44 corresponding to the slots 19*b* formed in the main printer unit 1 are disposed to the front of this back guide wall 43 as shown in FIG. 6 and FIG. 7. These positioning ribs 44 fit into the slots 19*b* in the main printer unit 1 and thus position the main printer unit 1 on the platform 41*a*. Note that FIG. 7 is drawn to emphasize the installation parts for the roll paper holder 40, and the roll paper holding unit 45 of the roll paper holder 40 is thus omitted from the figure.

A tab 44*a* is disposed to the vertical top end of one of the positioning ribs 44 (the left positioning rib 44 as seen in FIG. 7). As shown in FIG. 7 and FIG. 8, this tab 44*a* is inserted to the base unit back case 2*b* through an opening 19*c* formed at one lengthwise end of slot 19*b*. A roll paper holder connection sensor 38 is installed at a position corresponding to this opening 19*c* inside the base unit back case 2*b*.

This roll paper holder connection sensor 38 is composed of, for example, a sensor base 38*a* and a detection trigger 38*b* which is attached in order to move circularly to the sensor base 38*a*. When the tab 44*a* of the positioning rib 44 is inserted to opening 19*c*, the tab 44*a* contacts the detection trigger 38*b* and causes the detection trigger 38*b* to swing. The sensor base 38*a* detects this operation of the detection trigger 38*b* and outputs to the control circuit board 35. The controller on the control circuit board 35 thus knows that the roll paper holder 40 was installed.

The roll paper holding unit 45 is attached to the back of the back guide wall 43. The roll paper holding unit 45 is composed of guide members 46 and 47 which guide the widthwise sides of the roll paper CS, and a stationary spindle 49 which is fixed to the guide members 46 and 47 and allows the roll paper CS to turn. As shown in FIG. 8 the stationary spindle 49 supports the roll paper CS by passing through a through-hole formed in the center of the take-up spool, and allows the roll paper to roll around the stationary spindle 49 as the leading end of the roll paper is pulled out.

As also shown in FIG. 8 the roll paper holding unit 45 holds the roll paper CS so that when the roll paper is wound around the stationary spindle 49, the maximum height H of the roll paper CS is substantially equal to or slightly below the height of the paper transportation path. More specifically, when an unused roll of roll paper CS is loaded, the roll paper holding unit 45 holds the roll paper CS so that the maximum height H of the roll paper CS is substantially equal to or slightly below the height of the paper transportation path.

By thus holding the roll paper CS so that the maximum height H of the roll paper CS is substantially equal to or slightly below the height of the paper transportation path, the roll paper CS pulled out and conveyed through the paper transportation path 5 is not curled in the opposite direction as the curl of the wound roll when the paper enters the paper transportation path 5. It is thus more difficult for problems such as the leading edge of the roll paper CS snagging or jamming inside the paper transportation path 5 inside the main printer unit 1 to occur when the roll paper is inserted, and the roll paper CS can be conveyed smoothly through the paper transportation path 5 when the paper is transported.

This is achieved by means of this arrangement whereby the main printer unit base 41 raises the bottom of the main printer unit 1 and positions the paper transportation path 5 at a greater height from the desk surface so that the stationary spindle 49 can be positioned at a low position even when the diameter of the roll paper CS is large. Conversely, because the height of the stationary spindle 49 can be set low, the maximum height H of the roll paper CS can be held at substantially the same height or slightly lower than the height of the paper transportation path even when the diameter of the roll paper CS is large.

Note that the roll paper CS is loaded in the main printer unit 1 by depressing the release lever 15 so that the paper transportation path 5 is open and then inserting the paper to the paper transportation path 5 from the back opening 5*b*.

Manual insertion prevention tabs 50 and 51 are also formed as part of the guide members 46 and 47. As shown in FIG. 8, these manual insertion prevention tabs 50 and 51 are rendered so that when the main printer unit 1 is stationed in the main printer unit base 41 of the roll paper holder 40 the manual insertion prevention tabs 50 and 51 intersect the plane extending the paper transportation path 5 of the main printer unit 1 in the paper transportation direction. When the roll paper holder 40 is installed to the main printer unit 1, it is generally assumed that roll paper CS will be used for printing. Because roll paper CS will thus be loaded into the paper transportation path 5, manually inserting paper from the side opening 5*c* is undesirable because a paper jam or other problem will result (of course, this is undesirable even if roll paper CS is not located in the paper transportation path 5). These manual insertion prevention tabs 50 and 51 are therefore disposed to the roll paper holder 40 in the present embodiment so that these manual insertion prevention tabs 50 and 51 interfere with inserting paper from the side opening 5*c* and thus prevent improper manual paper insertion by the operator.

As described above, using roll paper holder 40 enables the main printer unit 1 to print images to roll paper CS. More specifically, printing on roll paper CS is enabled by simply attaching the roll paper holder 40 to the main printer unit 1 and loading roll paper CS in the paper transportation path 5.

Furthermore, when the roll paper holder 40 is installed, supplying paper by manual insertion is structurally prohibited as described above.

(ASF (Automatic Sheet Feeder))

FIG. 9 is an oblique view showing an ASF 60 installed to the main printer unit 1, and FIG. 10 is a section view showing the ASF 60 installed to the main printer unit 1.

A main printer unit 1 according to this embodiment of the invention is constructed so that an ASF 60 can be removably attached as a second attachment. The ASF 60 and installation thereof are described below.

The ASF 60 is a sheet feeding device that holds a plurality of slips of a specific size and supplies the slips one sheet at a time into the main printer unit 1. The ASF 60 is primarily composed of a bottom case 61 and a top cover 70. These parts are further described below.

The bottom case 61 is an integrally molded plastic box-like member having a front cover 62 and mutually opposing back cover 65 formed in unison with intervening side covers 63, 64, and a bottom cover 66 rendered on the bottom formed in unison with the side covers 63, 64 and back cover 65. An opening 60*a* is rendered at the top of the bottom case 61 between the front cover 62, side covers 63, 64, and back cover 65. The top cover 70 is inserted from the opening 60*a* and fit to the bottom case 61 such that a portion of the opening 60*a* is covered. The uncovered portion of the opening 60*a* is the paper insertion opening from which a plurality of slips S are inserted at an angle.

A flat paper guide 68 which supports the part of the slips S located above the back cover 65 is attached to the top end of the back cover 65. A paper size limiter 69 which limits the maximum size of slip paper that can be inserted from the opening 60*a* is also disposed at the top end of the back cover 65. This paper size limiter 69 can slide along the top end of the back cover 65 and the position of the paper size limiter 69 can thus be appropriately adjusted to limit the paper size. By setting the width between the paper size limiter 69 and the side cover 61 to substantially the same as the width of the paper that is to be inserted, the paper can be guided by the side cover 61 and paper size limiter 69 and inserted without tipping sideways.

A slope 66*a* is disposed on top of the bottom cover 66 of the bottom case 61 so that the surface of the slope 66*a* is inclined towards the bottom cover 66 as shown in FIG. 10. Inserted slips are thus held by the back cover 65 and the flat paper guide 68 in a stack in contact with the slope 66*a* or bottom cover 66.

Another opening 60*b* is rendered at the bottom of the bottom case 61 between the front cover 62, side covers 63, 64, and bottom cover 66. This opening 60*b* forms a slip discharge opening from which slips inserted from opening 60*a*, which is the slip insertion opening, exit.

As shown in FIG. 9, L-shaped hooks 67 are disposed on the front edges of the side covers 63, 64. These hooks 67 are rendered to match the slots 19*b* provided in the image recording unit back case 3*b* as shown in FIG. 2, and the ASF 60 is attached to the main printer unit 1 by engaging these hooks 67 in the slots 19*b*. FIG. 10 shows the ASF 60 installed to the main printer unit 1.

A mounting rib 71 is formed in unison with the top cover 70 on the inside of the top cover 70 (the side facing the back cover back cover 65), and paper feed roller unit 72 is attached to this mounting rib 71. This paper feed roller unit 72 has a gear 73 connected to a drive shaft 73*a* which is driven by a motor and cable not shown connected to the ASF drive cable connector 18, gear 74 meshing with gear 73, gear 75 meshing with gear 74, gear 76 meshing with gear 75, gear 77 meshing with gear 76, and a supply roller 78 with a gear 78*a* meshing with gear 77.

When the drive shaft 73*a* of gear 73 is driven forward or in reverse, the paper feed roller unit 72 moves circularly closer to the slips or away from the slips, and is held either in a position with the supply roller 78 in contact with the paper or in a position with the supply roller 78 separated from the paper. When the drive shaft 73*a* rotates with the supply roller 78 touching the paper, gear 73 turns, the torque of gear 73 is transferred through gears 74, 75, 76, 77 to gear 78*a*, and the supply roller 78 disposed coaxially to gear 78*a* turns.

Rotationally driving the drive shaft 73*a* of paper feed roller unit 72 to supply a slip to the main printer unit 1 causes paper feed roller unit 72 to move circularly to the slips S and causes the supply roller 78 to contact the surface of the slips S. Further rotationally driving the drive shaft 73*a* causes the supply roller 78 to rotate in the forward paper transportation direction (clockwise as seen in FIG. 10), feeds the topmost slip S on the stack of plural slips S at a constant speed from the opening 60*b*, and thus supplies the slip through the back opening 5*b* of the main printer unit 1 into the paper transportation path 5. The main printer unit 1 then records an image on the supplied paper and discharges the paper from the front opening 5*a*. If a next page is to be printed, paper is again fed from the ASF 60 into the paper transportation path 5 and an image is printed.

As shown in FIG. 10, when the ASF 60 is installed to the main printer unit 1, the bottom cover 66 is positioned near an extension of the paper transportation path 5. Because the back opening 5*b* is not closed by the ASF 60 when thus installed, paper can be manually supplied from the side opening 5*c* to the paper transportation path when the ASF 60 is installed.

As will be easily understood by comparison with FIG. 8, if the user attempts to install the ASF 60 to the main printer unit 1 while the roll paper holder 40 is installed to the main printer unit 1, the manual insertion prevention tabs 50 and 51 of the roll paper holder 40 will contact the bottom cover 66 of the ASF 60 and thus obstruct installing the 60. As a result, the ASF 60 cannot be installed to the main printer unit 1 if the roll paper holder 40 is also installed.

Likewise, if the user attempts to install the roll paper holder 40 to the main printer unit 1 while the ASF 60 is installed, the manual insertion prevention tabs 50 and 51 of the roll paper holder 40 will contact the bottom cover 66 of the ASF 60 and thus obstruct installing the roll paper holder 40. The roll paper holder 40 thus cannot be installed to the main printer unit 1 if the ASF 60 is installed. The arrangement of an inkjet printer according to this embodiment of the invention thus prohibits installing both the ASF 60 and roll paper holder 40 to the main printer unit 1 at the same time.

Installing the ASF 60 to the main printer unit 1 enables continuously supplying slips into the paper transportation path and enables printing images on the conveyed slips. Manual paper supply is also possible when the ASF 60 is installed.

(Inkjet Printer Control Circuit)

Figure 11:
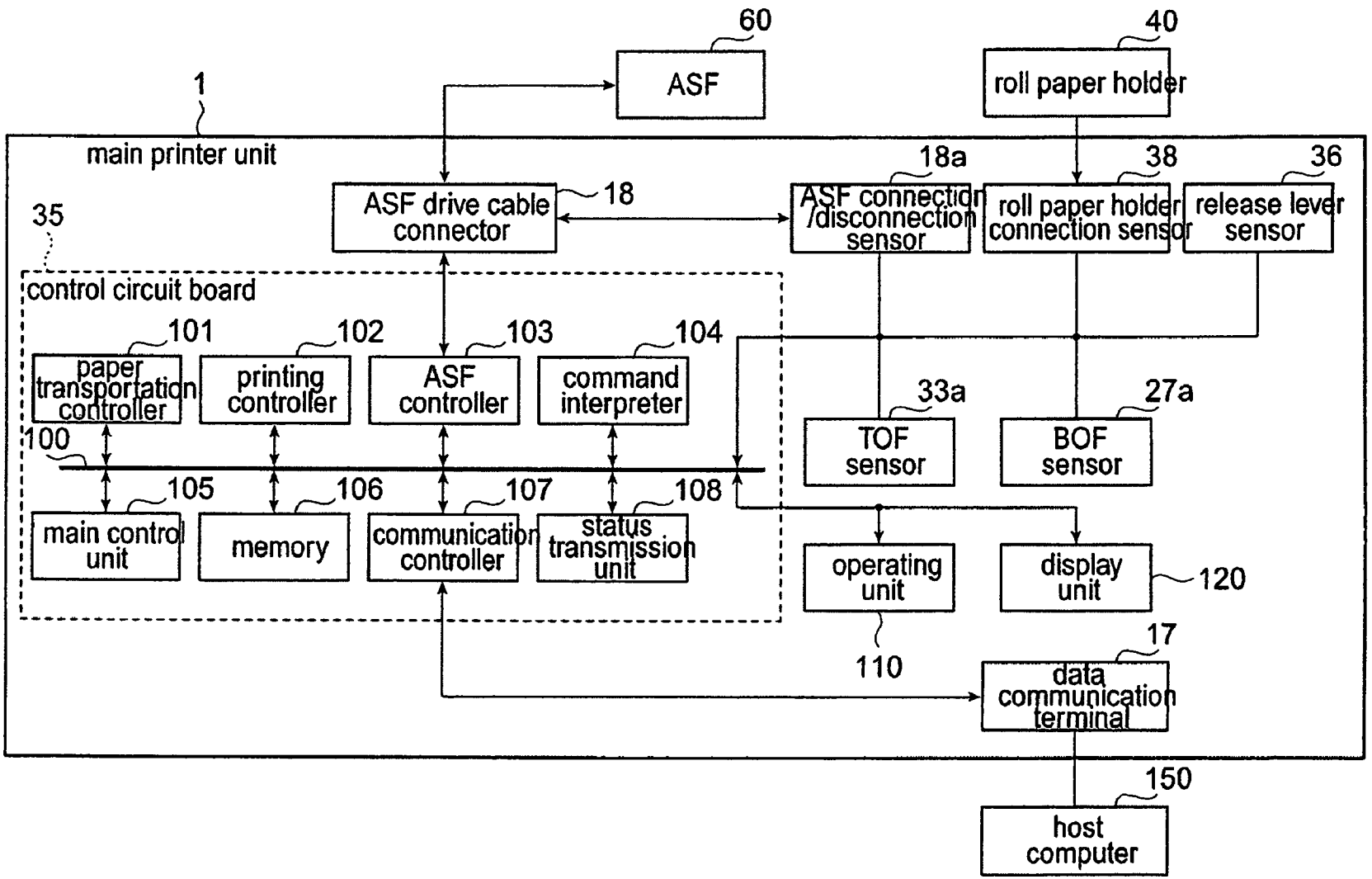
FIG. 11 is a block diagram showing the structure of the control circuit board and other parts controlling the main printer unit.

FIG. 11 is a block diagram showing the control circuit board 35 and other parts of the control mechanism for controlling the main printer unit 1.

In addition to control circuit board 35, the main printer unit 1 also has an ASF connection/disconnection sensor 18*a*, roll paper holder connection sensor 38, release lever sensor 36, TOF sensor 33*a*, BOF sensor 27*a*, ASF drive cable connector 18, data communication terminal 17, operating unit 110, and display unit 120.

The control circuit board 35 is the central control unit or control means which oversees the various control components of the main printer unit 1. More particularly, the control circuit board 35 has a paper transportation controller 101, printing controller 102, ASF controller 103, command interpreter 104, main control unit 105, memory 106, communication controller 107, and status transmission unit 108 connected to communicate with each other over a bus 100.

The paper transportation controller 101 is a control unit which generates control signals for driving the main paper transportation roller 23 and paper transportation subrollers 34 according to a paper feed command, and thus controls the main paper transportation roller 23 and paper transportation subrollers 34. The main paper transportation roller 23 and paper transportation subrollers 34 convey paper located inside the paper transportation path 5 in the paper transportation direction based on drive signals sent from the paper transportation controller 101. The main paper transportation roller 23 and paper transportation subrollers 34 thus index the paper in the paper transportation path 5, advance the paper one line at a time, and discharge the paper based on drive signals from the paper transportation controller 101.

The printing controller 102 controls driving the carriage 25, and based on print commands and image data received from an external source controls movement of the carriage 25 and discharging ink from the ink head (not shown in the figure) disposed to the carriage 25.

The ASF controller 103 is the control unit that controls the paper feed operation of the ASF 60 installed to the main printer unit 1. More specifically, the ASF controller 103 rotationally drives the supply roller 78 of the ASF 60 to feed slips S into the paper transportation path 5 according to received page break commands sent from an external host computer 150, operation of release lever 15, or operation of the paper feed button 9.

The command interpreter 104 is an interpreter for interpreting the content of control commands sent from an external host computer 150. The command interpreter 104 then sends the interpreted results to the controllers, including the paper transportation controller 101, printing controller 102, and ASF controller 103, according to the interpreted results. The controllers thus apply control according to the received control commands.

The main control unit 105 is a CPU, for example, which centrally controls communication between and operation of the paper transportation controller 101, printing controller 102, ASF controller 103, command interpreter 104, memory 106, communication controller 107, and status transmission unit 108 populating the control circuit board 35.

Memory 106 is a data storage area for temporarily storing commands and print data sent from the host computer 150.

The communication controller 107 is a control unit for controlling communication with the host computer 150 through the data communication terminal 17. The communication controller 107 temporarily stores commands and data sent from the host computer 150 to memory 106 for use by the other controllers and command interpreter.

The status transmission unit 108 generates status signals denoting the status of the main printer unit 1, and outputs the status signals to the host computer 150 through communication controller 107 and data communication terminal 17. The host computer 150 can thus determine the current status of the main printer unit 1 from the received status signals. Based on the status signals generated by the status transmission unit 108, status information could also be displayed on display unit 120 or printed out on paper.

The TOF sensor 33*a*, BOF sensor 27*a*, release lever sensor 36, ASF connection/disconnection sensor 18*a*, and roll paper holder connection sensor 38 respectively detect the presence of paper, whether the paper transportation path 5 is open or closed, and whether the ASF 60 and roll paper holder 40 are installed or not, and output corresponding detection signals to the control circuit board 35. In this embodiment of the invention the TOF sensor 33*a* and BOF sensor 27*a* constitute a paper detection means, and ASF connection/disconnection sensor 18*a* and roll paper holder connection sensor 38 constitute an installation detection means. The detection signals output by the TOF sensor 33*a*, BOF sensor 27*a*, release lever sensor 36, ASF connection/disconnection sensor 18*a*, and roll paper holder connection sensor 38 are sent over bus 100 to the main control unit 105. Based on these detection signals, the main control unit 105 controls the paper transportation controller 101, printing controller 102, and ASF controller 103, for example.

The operating unit 110 of the main printer unit 1 is composed of the power switch 7, cleaning button 8, and paper feed button 9 disposed on cantilever unit front case 4*a*. The display unit 120 of the main printer unit 1 consists of the power switch 7, cleaning button 8, and paper feed button 9 lighting steady or flashing as a result of the lamp member disposed behind the power switch 7, cleaning button 8, and paper feed button 9 lighting steady or flashing. The components of the operating unit 110 and display unit 120 are connected to the bus 100 of control circuit board 35, thus enabling communication with the control circuit board 35.

(Operational Control of the Inkjet Printer)

Figure 12:
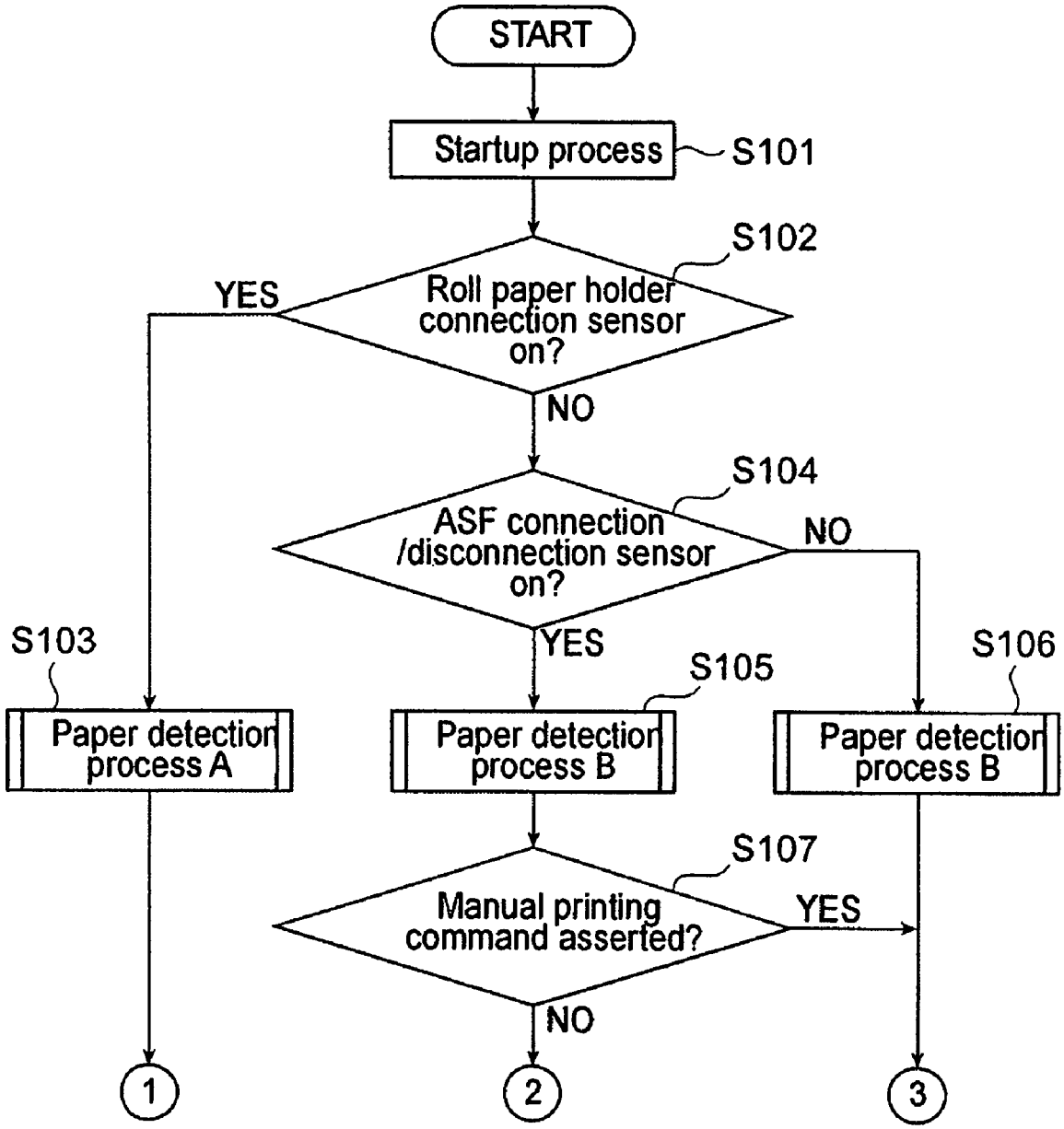
FIG. 12 is a flow chart describing the startup operation of the main printer unit.

Controlling the operation of an inkjet printer according to this embodiment of the invention is described next with reference to FIG. 12 to FIG. 17. FIG. 12 is a flow chart describing the startup operation of the main printer unit 1, FIG. 13 is a flow chart of the paper detection process A shown in FIG. 12, FIG. 14 is a flow chart of paper detection process B shown in FIG. 12, and FIG. 15 to FIG. 17 are state transition diagrams showing the internal status and state transitions of the main printer unit 1 when the roll paper holder 40 is installed, when the ASF 60 is installed, and when printing with manual paper insertion, respectively.

As shown in FIG. 12, when the power switch 7 of the main printer unit 1 turns on, the main printer unit 1 runs a specific startup process and gets ready for printing (step S101). When the specific startup process ends, the main control unit 105 determines if the roll paper holder connection sensor 38 is on (step S102).

If the roll paper holder connection sensor 38 is on, that is, if the roll paper holder 40 is installed to the main printer unit 1, the main control unit 105 determines that roll paper will be used for printing and thus runs paper detection process A in step S103. However, if the roll paper holder connection sensor 38 is off, that is, the roll paper holder 40 is not installed to the main printer unit 1, control goes to step S104.

Figure 13:
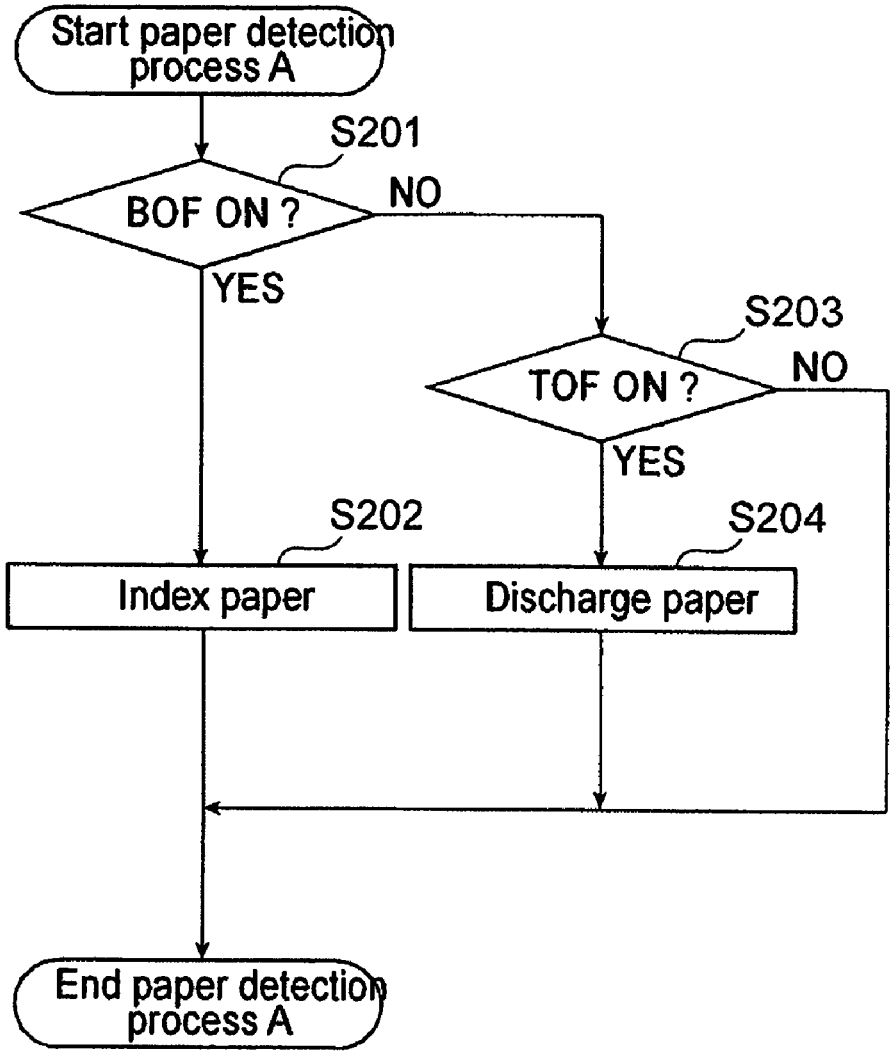
FIG. 13 is a flow chart of paper detection process A shown in FIG. 12.
Figure 14:
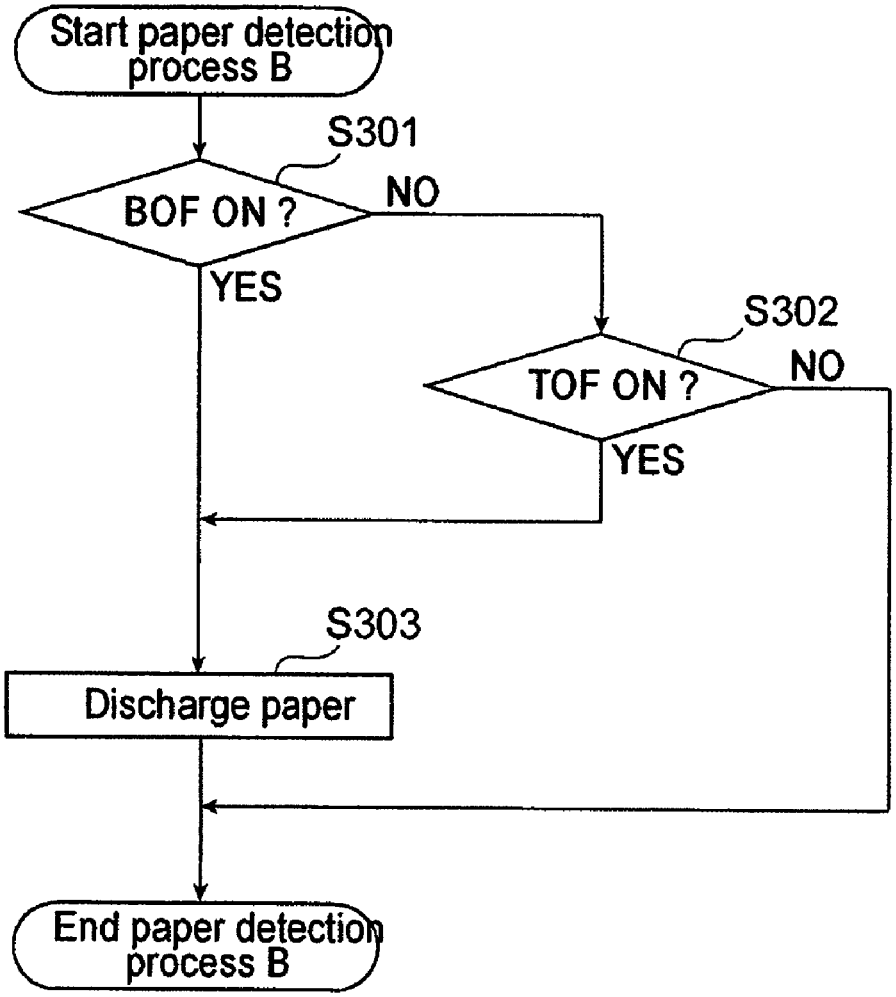
FIG. 14 is a flow chart of paper detection process B shown in FIG. 12.

In the paper detection process A run in step S103, the main control unit 105 first determines if BOF sensor 27*a* is on or off (step S201) as shown in the flow chart in FIG. 13. If the BOF sensor 27*a* is on, that is, if paper is present at the position detected by the BOF lever 27 inside the paper transportation path 5, the main paper transportation roller 23 is driven to index the paper in step S202, and paper detection process A ends.

The paper is indexed for printing by advancing the paper until the paper is detected by the TOF sensor 33*a*, then conveying the paper a specified distance in the reverse direction so that the leading edge of the paper is located at a specified position. Note this procedure is always used when the paper is indexed in this embodiment of the invention.

If the BOF sensor 27*a* is off, that is, if paper is not present at the position detected by the BOF lever 27 in the paper transportation path 5, control goes to step S203 and the on/off state of the TOF sensor 33*a* is detected.

Furthermore, if the release lever sensor 36 detects that the paper transportation path 5 is open before paper detection process A is executed, the user could be prompted to close the paper transportation path 5 by, for example, causing the lamp members disposed behind the power switch 7, cleaning button 8, and paper feed button 9 and constituting the display unit 120 to flash.

Instead of causing these lamp members to flash, the status transmission unit 108 could alternatively generate a status signal indicating that the release lever is in the open position and send this status signal to the host computer 150 so that the host computer 150 displays a message such as "The release lever is open" on a display.

The main control unit 105 determines if the TOF sensor 33*a* is on or off in step S203. If the TOF sensor 33*a* is on, that is, if paper is present at the position detected by the TOF lever 33, the paper inside the paper transportation path 5 is discharged from the front opening 5*a* in step S204, and the paper detection process ends. On the other hand, if TOF sensor 33*a* is off, that is paper is not located in the paper transportation path 5 at the position detected by the TOF lever 33, the paper detection process A ends immediately.

Figure 15:
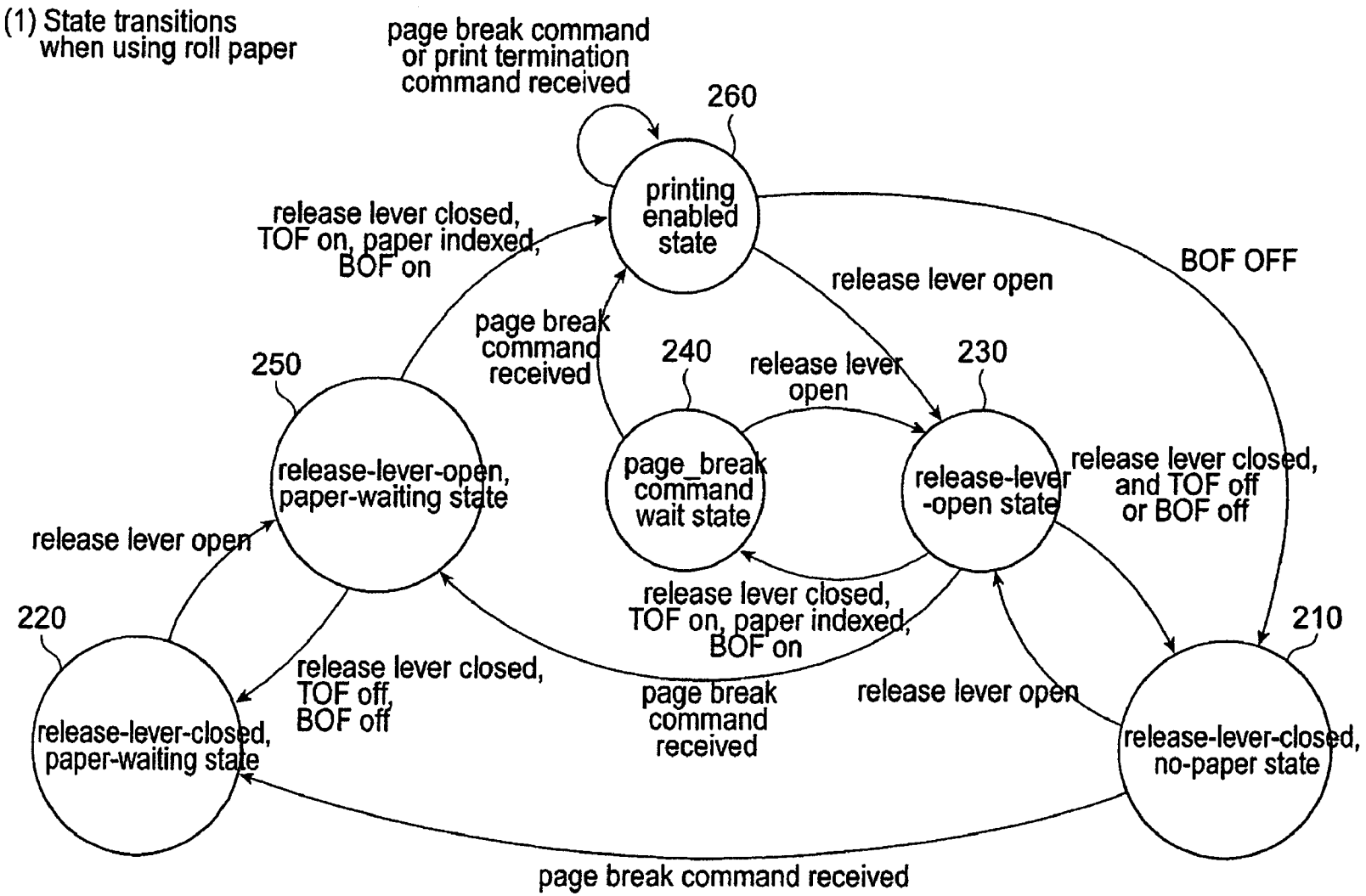
FIG. 15 is a state diagram showing the internal status and state changes in the main printer unit when the roll paper holder is installed.

As a result of executing this paper detection process A, paper is discharged if paper is present only at the position in the paper transportation path 5 detected by the TOF lever 33, and the paper is indexed if the paper is only present at the position in the paper transportation path 5 detected by the BOF lever 27. More specifically, if paper is located in the paper transportation path 5 at a position that is not useful for roll paper printing (specifically at a position detected only by the TOF sensor 33*a*), the paper will be discharged as a result of executing this paper detection process A. After paper detection process A ends, one of the states shown in the state transition diagram shown in FIG. 15 is assumed. FIG. 15 is described in further detail below.

Returning first to FIG. 12, the main control unit 105 determines if the ASF connection/disconnection sensor 18*a* is on in step S104.

If the ASF connection/disconnection sensor 18*a* is on, that is, if the ASF 60 is installed to the main printer unit 1, paper detection process B is executed in step S105. If the ASF connection/disconnection sensor is off, that is, the ASF 60 is not installed to the main printer unit 1, manual paper insertion will be used for printing and paper detection process B is executed in step S106.

In the paper detection process B executed in step S1105, the main control unit 105 first determines if the BOF sensor 27*a* is on or off (step S301) as shown in the flow chart in FIG. 14. If the BOF sensor 27*a* is on, that is, paper is present at the position detected by the BOF lever 27, the main paper transportation roller 23 is driven and the paper in the paper transportation path 5 is discharged from the front opening 5*a* in step S303.

If the BOF sensor 27*a* is off, that is, paper is not present at the position detected by the BOF lever 27, whether the TOF sensor 33*a* is on or off is detected in step S302.

Furthermore, if the release lever sensor 36 detects that the paper transportation path 5 is open before paper detection process B is executed, the user could be prompted to close the paper transportation path 5 by, for example, causing the lamp members disposed behind the power switch 7, cleaning button 8, and paper feed button 9 and constituting the display unit 120 to flash.

Instead of causing these lamp members to flash, the status transmission unit 108 could alternatively generate a status signal indicating that the release lever is in the open position and send this status signal to the host computer 150 so that the host computer 150 displays a message such as "The release lever is open" on a display.

The main control unit 105 detects if the TOF sensor 33*a* is on or off in step S302. If the TOF sensor 33*a* is on, that is, if paper is present at the position detected by the TOF lever 33, the paper inside the paper transportation path 5 is discharged from the front opening 5*a* in step S303, and the paper detection process B ends. On the other hand, if TOF sensor 33*a* is off, that is paper is not located in the paper transportation path 5 at the position detected by the TOF lever 33, the paper detection process B ends immediately.

Paper present in the paper transportation path 5 at the position detected by the TOF lever 33 or BOF lever 27 is thus discharged as a result of executing this paper detection process B. More specifically, if paper is present in the paper transportation path 5 (and is positioned where the paper is detected by at least one of the TOF sensor 33*a* and BOF sensor 27*a*) before slip printing starts, the paper is discharged as a result of executing paper detection process B. After paper detection process B ends, one of the states shown in the state transition diagram shown in FIG. 15 is assumed. FIG. 15 is described in further detail below.

Returning again to the flow chart in FIG. 12, whether a manual paper insertion command was asserted by the user is detected in step S107 after the paper detection process is completed in step S105. This manual insertion command can be asserted by operating the operating unit 110 or by a print command from the host computer 150. If the operating unit 110 is used to control printing with manual paper insertion, a manual printing command could be asserted by, for example, holding the paper feed button depressed for an extended time.

Alternatively, a DIP switch or memory switch could be provided in the main printer unit 1 and said switch could be operated to control manual insertion printing.

Figure 16:
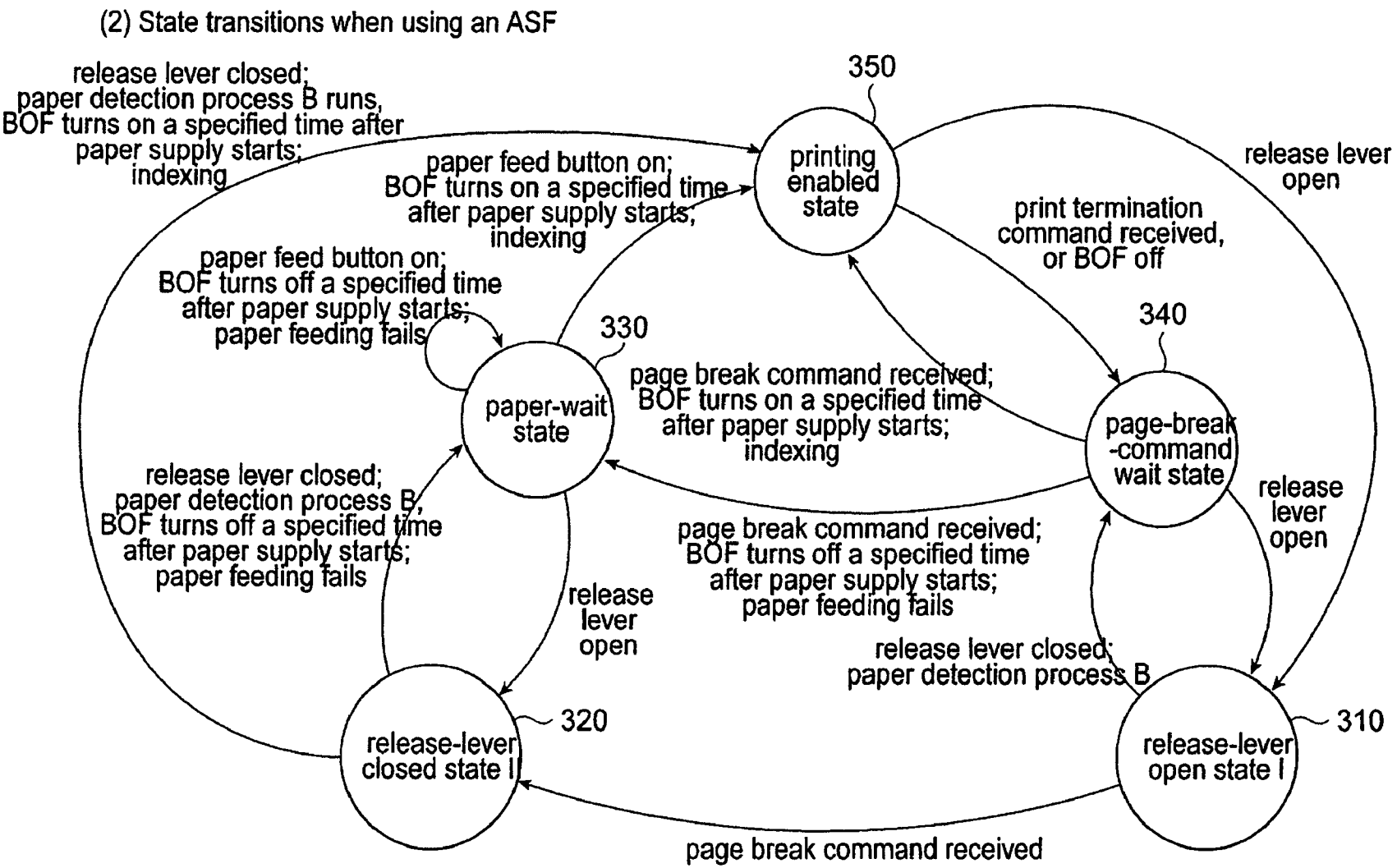
FIG. 16 is a state diagram showing the internal status and state changes in the main printer unit when the ASF is installed.
Figure 17:
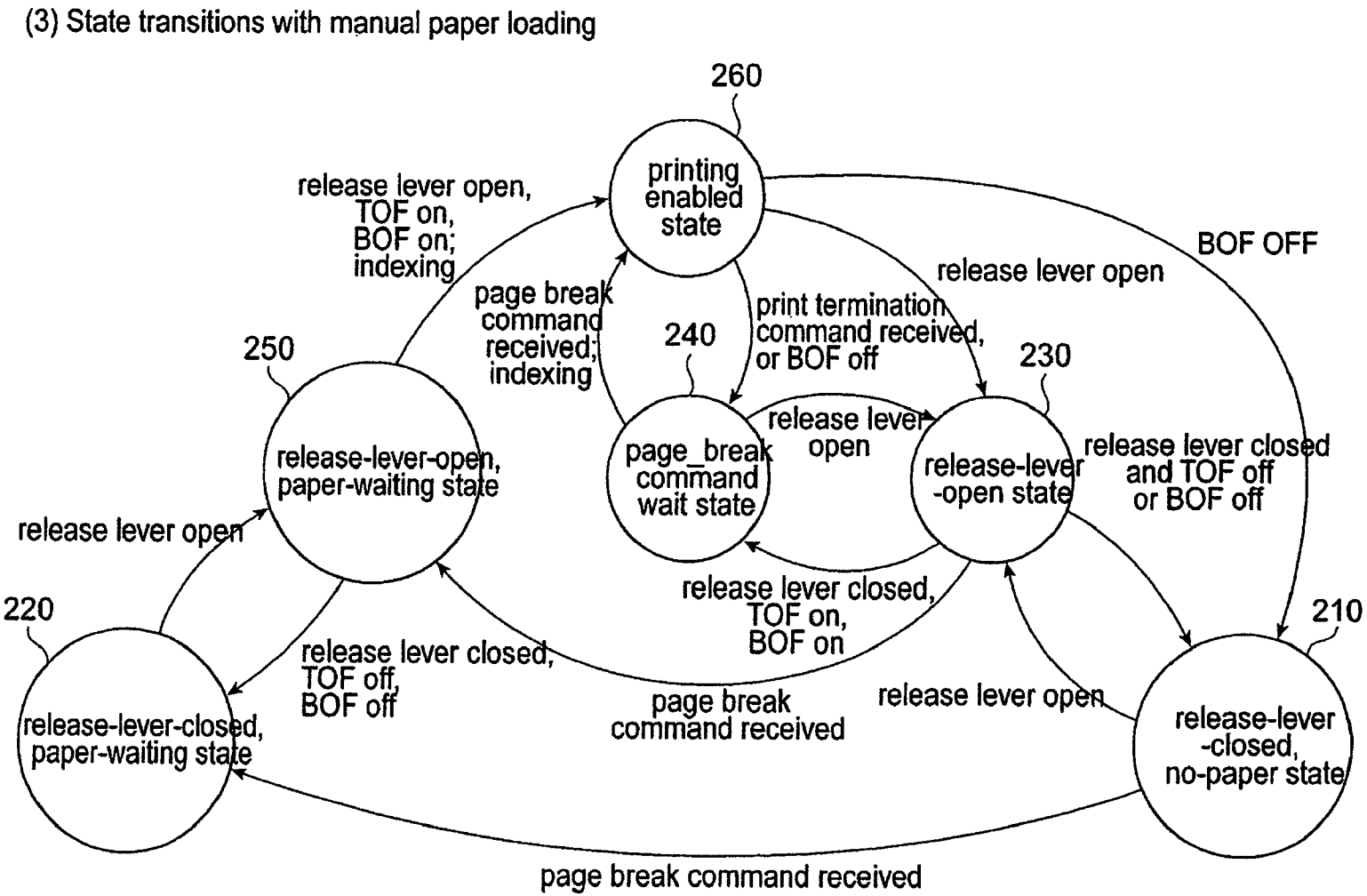
FIG. 17 is a state diagram showing the internal status and state changes in the main printer unit when printing with manual paper insertion.

If a manual insertion command is detected, printing is to proceed with manually inserted paper even though the ASF 60 is installed, and one of the states shown in the state transition diagram in FIG. 17 is assumed. If a manual insertion command is not detected, printing is to proceed using the ASF 60, and one of the states shown in the state transition diagram in FIG. 16 is assumed. FIG. 16 and FIG. 17 are further described below.

Paper detection process B is executed in step S106 in FIG. 12 in the same way as in step S105 according to the flow chart shown in FIG. 14. After paper detection process B ends, one of the states shown in the state transition diagram shown in FIG. 17 is assumed.

As described above, an inkjet printer according to this embodiment of the invention changes the paper detection process and prepares for printing to paper according to whether a roll paper holder is installed, an ASF is installed, or neither is installed.

(State Transitions During Roll Paper Printing)

State transitions during roll paper printing are described below with reference to the state transition diagram shown in FIG. 15. The states of the main printer unit 1 during roll paper printing include a "release-lever-closed, no-paper state" 210, a "release-lever-closed, paper-waiting state" 220, a "release-lever-open state" 230, a "page_break command wait state" 240, a "release-lever-open, paper-waiting state" 250, and a "printing enabled state" 260. These states are grouped according to the state of the release lever, the presence of roll paper in the paper transportation path, and the presence of a page break command. The states shown in the state transition diagram in FIG. 15, the state transition conditions, and the destination state are described first below.

The release-lever-closed, no-paper state 210 is the state in which the release lever 15 is closed, roll paper. CS is not present in the paper transportation path 5, and a page break command, which is a print command, has not been received from the host computer 150. If when in this release-lever-closed, no-paper state 210 the release lever 15 is operated so that the release lever 15 changes to the open position, there is a transition to the release-lever-open state 230. However, if a page break command is received from the host computer 150 while in the release-lever-closed, no-paper state 210, there is a transition to the release-lever-closed, paper-waiting state 220.

The release-lever-closed, paper-waiting state 220 is the state in which the release lever 15 is closed, roll paper CS is not present in the paper transportation path 5, and a page break command has been received from the host computer 150. Roll paper CS must be inserted for printing when in this release-lever-closed, paper-waiting state 220. When the release lever 15 is opened to insert the roll paper CS, there is a transition to the release-lever-open, paper-waiting state 250.

In the release-lever-open state 230 the release lever 15 is open, roll paper CS is not present in the paper transportation path 5, and a page break command has not been received from the host computer 150. That is, because the release lever 15 is open in this release-lever-open state 230, the roll paper CS is not located in the paper transportation path 5, and the page break command that is the print command has not been received.

If roll paper CS is inserted to the paper transportation path 5, the release lever sensor 36 confirms that the release lever 15 is in the closed state because the release lever 15 was closed, and TOF sensor 33*a* and BOF sensor 27*a* turn on and thus detect the roll paper CS when in the release-lever-open state 230, there is a transition to the page_break command wait state 240. If a page break command is received in the release-lever-open state 230, there is a transition to the release-lever-open, paper-waiting state 250.

If the release lever 15 is closed without roll paper CS being inserted when in the release-lever-open state 230, the release lever sensor 36 confirms that the release lever 15 is closed, both TOF sensor 33*a* and BOF sensor 27*a* turn off, and there is a transition to the release-lever-closed, no-paper state 210.

In the page_break command wait state 240 the release lever 15 is closed, roll paper CS is present in the paper transportation path 5, and a page break command has not been received from the host computer 150. The page break command asserted as a print command has thus not been received but the roll paper CS has been indexed for printing in the paper transportation path 5 when in the page_break command wait state 240. If a page break command is then received from the host computer 150 when in this page_break command wait state 240, there is a transition to the printing enabled state 260. If the release lever 15 is operated so that the release lever 15 is opened when in the page_break command wait state 240, there is a transition to the release-lever-open state 230.

In the release-lever-open, paper-waiting state 250 the release lever 15 is open, roll paper CS is not present in the paper transportation path 5, and the page break command has been received from the host computer 150. Because the page break command is received when in the release-lever-open, paper-waiting state 250, printing is enabled once the roll paper CS is inserted to the paper transportation path 5.

If roll paper CS is loaded into the paper transportation path 5, the release lever 15 is closed and the release lever sensor 36 thus recognizes that the release lever 15 is closed, and the TOF sensor 33*a* and BOF sensor 27*a* detect the roll paper CS and thus turn on when in the release-lever-open, paper-waiting state 250, the roll paper CS is indexed and there is a transition to the printing enabled state 260.

If the release lever 15 is closed without roll paper CS being inserted when in the release-lever-open, paper-waiting state 250, the release lever sensor 36 confirms that the release lever 15 is closed, TOF sensor 33*a* and BOF sensor 27*a* both turn off, and there is a transition to the release-lever-closed, paper-waiting state 220.

In the printing enabled state 260 the release lever 15 is closed, roll paper CS is indexed for printing in the paper transportation path 5, and a page break command has been received from the host computer 150. When the image data to be printed according to the page break command is received from the host computer 150 in this printing enabled state 260, printing commences immediately.

If the roll paper holder 40 is installed to the main printer unit 1 the printable area after a page break command is received when in the printing enabled state 260 is the entire length of the paper roll. As a result, there is no state change, or more specifically there is a recursive transition returning to the printing enabled state 260, when the image data for one print command is printed and a printing termination command or page break command is received.

Furthermore, if the release lever 15 is operated in the printing enabled state 260 so that the release lever 15 opens, printing is interrupted while printing is in progress, and there is a transition to the release-lever-open state 230. Image data relating to the page break command processed before the release lever 15 opened is destroyed in this state transition. More specifically, the image data being printed is immediately killed without being printed as soon as the release lever 15 is opened. However, page break commands that have been received but not processed at that time and related image data are stored to memory 106 and thus not lost, and there is a transition from the release-lever-open state 230 to the release-lever-open, paper-waiting state 250.

If the roll paper CS is printed to the end of the roll and the roll paper is completely discharged, BOF sensor 27*a* turns off and the release-lever-closed, no-paper state 210 is entered. If there is any image data relating to page break commands processed before the BOF sensor 27*a* turned off, that image data is lost during this state transition. In other words, any image data that was in the process of being printed when the BOF sensor 27*a* turns off is deleted without being printed. However, any page break commands that have been received but not yet processed when the BOF sensor 27*a* turns off and the related image data are written to memory 106, and there is a state transition from the release-lever-closed, no-paper state 210 to the release-lever-closed, paper-waiting state 220.

In the process continuing from the flow shown in the flow chart in FIG. 12, operation starts from the page_break command wait state 240 if the roll paper CS is indexed inside the paper transportation path 5. If the roll paper CS has not been indexed in the paper transportation path 5 after completing the process shown in FIG. 12, operation starts from the release-lever-closed, no-paper state 210. A transition from these states to the printing enabled state 260 is then triggered by appropriately loading roll paper and sending a page break command to the main printer unit 1, and image data received in the printing enabled state 260 is then printed.

The roll paper CS is described above as being indexed when both the TOF sensor 33*a* and BOF sensor 27*a* turn on while the release lever 15 is closed. The invention shall not be so limited, however. For example, the BOF sensor 27*a* turning on could cause the paper to be advanced in the paper transportation direction until the paper is sensed by the TOF sensor 33*a*, and the paper could then be indexed.

(State Transitions During Slip Printing Using the ASF 60)

State transitions during slip printing using the ASF 60 are described next with reference to the state transition diagram shown in FIG. 16.

The states of the main printer unit 1 during slip printing using the ASF 60 include a "release-lever-open state I" 310, a "release-lever-closed state II" 320, "paper-wait state" 330, "page-break-command wait state" 340, and "printing enabled state" 350. These states are grouped according to the state of the release lever and the presence of a page break command. During slip printing using the ASF 60 paper is only supplied after a page break command is received and the printing enabled state 350 is entered. The states of the main printer unit 1 and the state transition conditions are thus slightly different from when roll paper is used for printing.

In release-lever-open state I 310 the release lever 15 is open and a page break command has not been received. If the release lever 15 is operated in this state so that the release lever 15 closes, paper detection process B shown in FIG. 14 is executed to discharge the unneeded paper from the paper transportation path 5, and there is a transition to the page —break-command wait state 340. If a page break command is received from the host computer 150 while in release-lever-open state I 310, there is a transition to the release-lever-closed state II 320.

In release-lever-closed state II 320 the release lever 15 is open and the page break command was received. If the release lever 15 is operated so that the release lever 15 is closed in this state, paper detection process B shown in FIG. 14 is executed to discharged unnecessary paper from the paper transportation path 5, and a slip S is then supplied from the ASF 60 to the paper transportation path 5.

If the BOF sensor 27*a* turns on within a specified time after paper feeding starts, that is, if the BOF sensor 27*a* confirms that a slip S was fed into the paper transportation path 5, the slip S is indexed and the printing enabled state 350 is entered.

If the BOF sensor 27*a* remains off after a specified time after paper feeding starts, supplying a slip S into the paper transportation path 5 is determined to have failed and there is a transition to the paper-wait state 330.

In the paper-wait state 330 the release lever 15 is closed, a page break command was received, but supplying a slip S failed. Supplying a slip S again is not automatically attempted in the paper-wait state 330. Instead, paper feeding is tried again when the paper feed button 9 turns on as a result of the user pressing the paper feed button 9 on the operating unit 110.

If the BOF sensor 27*a* turns on within a specified time after the paper feeding operation resumes, that is, if it is confirmed that a slip S was supplied into the paper transportation path 5, the slip S is indexed and there is a transition to the printing enabled state 350.

However, if the BOF sensor 27*a* remains off after a specified time after paper feeding starts, supplying a slip S into the paper transportation path 5 is determined to have failed again and there is a recursive transition to the paper-wait state 330.

In the page-break-command wait state 340 the release lever 15 is closed and the page break command has not been received. Supplying a slip S from the ASF 60 starts when a page break command is received in this state.

If the BOF sensor 27*a* turns on within a specified time after the paper feeding operation resumes, that is, if it is confirmed that a slip S was supplied into the paper transportation path 5, the slip S is indexed and there is a transition to the printing enabled state 350.

If the BOF sensor 27*a* remains off after a specified time after paper feeding starts, supplying a slip S into the paper transportation path 5 is determined to have failed and there is a transition to the paper-wait state 330.

In the printing enabled state 350 the release lever 15 is closed, a slip S has been indexed in the paper transportation path 5, and a page break command has been received from the host computer 150. When the image data to be printed for the received page break command is then received from the host computer 150 in this state, printing commences immediately.

If a printing termination command is received from the host computer 150 in this printing enabled state 350, or if the BOF sensor 27*a* turns off because printing one page ends and the slip S is discharged, there is a transition to the page-break-command wait state 340.

However, if the release lever 15 is operated in the printing enabled state 350 so that the release lever 15 opens, printing is interrupted even in the middle of the printing process, and there is a transition to release-lever-open state I 310. Image data relating to page break commands processed before the release lever 15 was opened is destroyed by this state transition. That is, image data being printed when the release lever 15 is opened is deleted without being printed. However, any page break commands and corresponding image data that has already been received but not yet processed is saved to memory 106 instead of being deleted, and there is a transition from release-lever-open state I 310 to release-lever-closed state II 320.

The process following the flow shown by the flow chart in FIG. 12 starts from the page-break-command wait state 340. When a page break command is received in the page-break-command wait state 340, there is a transition to the printing enabled state 350. When image data is then received in the printing enabled state 350, printing commences immediately.

(State Transitions During Manual Printing)

The state transitions during printing with manual paper insertion are described next with reference to the state transition diagram in FIG. 17.

The states of the main printer unit 1 during manual printing include a release-lever-closed, no-paper state 210, release-lever-closed, paper-waiting state 220, release-lever-open state 230, page_break command wait state 240, release-lever-open, paper-waiting state 250, and printing enabled state 260.

These states are grouped according to the state of the release lever, the presence of roll paper in the paper transportation path, and the presence of a page break command. The release-lever-closed, no-paper state 210, release-lever-closed, paper-waiting state 220, release-lever-open state 230, page_break command wait state 240, and release-lever-open, paper-waiting state 250 and the related state transition conditions differ only according to whether the paper inserted to the paper transportation path 5 is roll paper or manually inserted paper, and these states are identical to the roll paper printing states shown in FIG. 15 and identified by the same reference numerals.

The only differences between manual printing and roll paper printing are the state transition conditions from the printing enabled state 260.

In the printing enabled state 260 the release lever 15 is closed, manually inserted paper is indexed to the desired position in the paper transportation path 5, and a page break command has been received from the host computer 150. Printing commences immediately in this state when image data to be printed for the page break command is received from the host computer 150.

Unlike during roll paper printing, in the printing enabled state 260 during manual printing the printable area corresponding to the page break command is limited to the manually inserted slip. As a result, there is a transition to the page_break command wait state 240 when the BOF sensor 27*a* turns off because printing some image data ends and a print termination command is received from the host computer 150, or printing one page ends and the manually inserted page is discharged.

If the release lever 15 is operated in this printing enabled state 260 so that the release lever 15 is opened, printing in any printing process in progress is interrupted and there is a transition to the release-lever-open state 230. Image data relating to page break commands processed before the release lever 15 was opened is destroyed by this state transition. That is, image data being printed when the release lever 15 is opened is deleted without being printed. However, any page break commands and corresponding image data that has already been received but not yet processed is saved to memory 106 instead of being deleted, and there is a transition from release-lever-open state 230 to release-lever-open, paper-waiting state 250.

If the manually inserted paper is printed to the end of the slip and the manually inserted paper is completely discharged in the printing enabled state 260, BOF sensor 27*a* turns off and the release-lever-closed, no-paper state 210 is entered. If there is any image data relating to page break commands processed before the BOF sensor 27*a* turned off, that image data is lost during this state transition. That is, if the end of the page is reached before printing ends, the unprinted image data left in that printing process is deleted without being printed. However, any page break commands that have been received but not yet processed when the BOF sensor 27*a* turns off and the related image data are written to memory 106, and there is a state transition from the release-lever-closed, no-paper state 210 to the release-lever-closed, paper-waiting state 220.

In the process continuing from the flow shown in the flow chart in FIG. 12, operation starts from the release-lever-closed, no-paper state 210. A transition from this state to the printing enabled state 260 is then triggered by manually inserting paper and sending a page break command to the main printer unit 1, and image data received in the printing enabled state 260 is then printed.

In summary, an inkjet printer according to this embodiment of the invention as described above has a main printer unit 1 which has a image recording unit 3, which has a carriage 25 on which an ink head for discharging ink to paper and a guide shaft 26 for slidably guiding the carriage 25, and a base unit 2, which is disposed opposite the image recording unit 3 and supports the image recording unit 3. A paper transportation path 5 is rendered between the image recording unit 3 and base unit 2. A roll paper holder 40 for supplying roll paper CS as the print medium to the paper transportation path 5 can be removably installed to the main printer unit 1, and an ASF 60 for continuously supplying a plurality of single sheets as the recording medium to the paper transportation path 5 can be removably installed to the main printer unit 1.

Because the roll paper holder 40 and ASF 60 can thus be installed to and removed from the main printer unit 1, the arrangement of the inkjet printer can be changed according to the printing application to enable printing to manually fed paper, slip printing, and roll paper printing.

This main printer unit 1 also has an ASF connection/disconnection sensor 18*a* as a sheet feeding device detector for determining if the ASF 60 is installed to the main printer unit 1; a roll paper holder connection sensor 38 as a roll paper holder detector for determining if the roll paper holder 40 is installed to the main printer unit 1; and a control circuit board 35 for controlling operation of the main printer unit 1 according to the detection status of the ASF connection/disconnection sensor 18*a* and roll paper holder connection sensor 38.

In an inkjet printer according to this embodiment of the invention the control circuit board 35 controls operation of the main printer unit 1 according to the detection status of the ASF connection/disconnection sensor 18*a* and roll paper holder connection sensor 38. More specifically, operation of the main printer unit 1 is controlled according to the printing pattern, which varies according to whether the roll paper holder 40 is installed to the main printer unit 1, the ASF 60 is installed to the main printer unit 1, or paper is manually inserted for printing.

An inkjet printer according to this embodiment of the invention thus easily enables various printing operations with minimal user intervention required. Without being greatly aware of the differences in roll paper printing, slip printing, and manual printing, the user can thus load the desired paper and send print commands from the host computer 150 to easily accomplish the desired printing task.

The main printer unit 1 in this embodiment of the invention yet further preferably also has a TOF sensor 33*a* as a top of form detector for detecting the leading end of the paper in the paper transportation path 5, a BOF sensor 27*a* as a bottom of form detector for detecting the trailing end of the paper in the paper transportation path 5, and a release lever sensor 36 as a paper detector for detecting whether the paper transportation path 5 is open or closed. The inkjet printer according to this embodiment of the invention controls operation of the main printer unit 1 according to the detection status of the TOF sensor 33*a*, BOF sensor 27*a*, and release lever sensor 36.

More specifically, an inkjet printer according to this embodiment of the invention prints only when the TOF sensor 33*a*, BOF sensor 27*a*, and release lever sensor 36 are on and a page break command has been supplied. Meaningless printing operations are thus not executed when printing is not possible, and an inkjet printer that is easy to use can be provided.

Furthermore, if the release lever sensor 36 determines that the paper transportation path 5 is closed and the TOF sensor 33*a* and BOF sensor 27*a* each detect paper when the roll paper holder 40 is installed, the control circuit board 35 determines that printing to paper is possible and thus prints the received image data. Meaningless printing operations are thus not executed when printing is not possible, and an inkjet printer that is easy to use can be provided.

Furthermore, if the release lever sensor 36 determines that the paper transportation path 5 is closed when the ASF 60 is installed to the main printer unit 1 and either the TOF sensor 33*a* or BOF sensor 27*a* detects paper, the detected paper is discharged. Because paper in the paper transportation path 5 is automatically discharged if paper is already in the paper transportation path 5 before the ASF 60 supplies a slip S, the inkjet printer can prevent problems such as incomplete printing on the paper without the user needing to bother with removing the paper.

Furthermore, if the release lever sensor 36 determines that the paper transportation path 5 is closed and the TOF sensor 33*a* and BOF sensor 27*a* both detect paper during manual printing when neither the roll paper holder 40 or the ASF 60 is installed to the main printer unit 1, image recording on the paper is determined possible, and printing proceeds according to the received image data. Meaningless printing operations are thus not executed when printing is not possible, and an inkjet printer that is easy to use can be provided.

An inkjet printer according to this embodiment of the invention also has a side opening 5*c* enabling inserting paper to the paper transportation path 5 from a direction substantially perpendicular to the paper transportation direction rendered between the image recording unit 3 and base unit 2. More specifically, the side opening 5*c* is provided by securing the image recording unit 3 cantilevered from one end of the base unit 2 on an intervening cantilever unit 4.

An inkjet printer according to this embodiment of the invention thus easily enables manually supplying paper through the side opening 5*c* into the paper transportation path 5. Furthermore, because paper can be supplied from the side (a direction substantially perpendicular to the paper transportation path), there is no limit to the size of paper and paper can be manually supplied to the paper transportation path 5 regardless of the shape of the paper. It is therefore possible to supply only one page of an already bound volume such as a book or notebook into the paper transportation path 5, and special printing applications such as printing images on individual pages of a bound volume are possible.

The roll paper holder 40 is attached to the base unit 2 of the main printer unit 1 and the ASF 60 is attached to the image recording unit of the main printer unit 1 in an inkjet printer according to this embodiment of the invention, but the invention shall not be so limited and could be arranged so that the roll paper holder 40 is attached to the image recording unit 3 using slots 19*a*, for example.

Furthermore, the manual insertion prevention tab 50 could be disposed projecting in front of the side opening 5*c* in order to obtrude the side opening 5*c*. The guide wall 41*b* could also be shaped so that it extends and obtrudes the side opening 5*c*. Manually supplying paper can be structurally prohibited by means of these variations.

The present invention has been described using an inkjet printer by way of example above, but a printer according to the present invention shall not be limited to an inkjet printer and the present invention can be applied to other types of printers, including thermal and dot impact printers.

INDUSTRIAL APPLICABILITY

The control unit of a printer according to the present invention controls the main printer unit according to the detection status of a sheet feeding device detector and a roll paper supply device detector. More specifically, operation of the main printer unit is controlled according to a printing pattern which varies according to whether a roll paper holder is installed to the main printer unit, a sheet feeding device is installed to the main printer unit, or manual feed printing is selected.

Therefore, a printer according to the present invention easily enables various printing operations with minimal user intervention. Without being greatly aware of the differences in roll paper printing, slip printing, and manual printing, the user can thus load the desired paper and send print commands from an external host to easily accomplish the desired printing task.

What is claimed is:

1. A control method for operating a printer comprising a main printer unit having a paper transportation path formed therein with an open position to enable paper to be inserted into the paper transportation path and a closed position for preventing the insertion of paper into the paper transportation path, the printer further comprising, a roll paper holder, a sheet feeding device and connector guides for said sheet feeding device configured such that only the roll paper holder or the sheet feeding device can be installed to the main printer unit at any one time, the method comprising:

installing the roll paper holder in the main printer unit at a first location when the sheet feeding device is not installed for feeding roll paper to said paper transportation path;

installing the sheet feeding device in the main printer unit at a second location different from the first location when the roll paper holder is not installed for feeding sheet paper to said paper transportation path;

using optical sensors for simultaneously detecting if the roll paper holder is installed to the printer when power to the printer is turned on, and at the same time detecting if the sheet feeding device is not installed to the printer, and if so:

determining if the paper transportation path is in the closed position;

detecting a leading end and a trailing end of paper in the paper transportation path;

discharging the paper from the paper transportation path when only the leading end of the paper is detected or indexing the paper in the paper transportation path when only the trailing end of the paper is detected.

2. A control method for operating a printer comprising a main printer unit having a paper transportation path formed therein with an open position to enable paper to be inserted into the paper transportation path and a closed position for preventing the insertion of paper into the paper transportation path, the printer further comprising, a roll paper holder, a sheet feeding device adapted for installation to the main printer unit at a second location different from the first location for feeding sheet paper to said paper transportation path and connector guides for said sheet feeding device configured such that only the roll paper holder or the sheet feeding device can be installed to the main printer unit at any one time, the method comprising:

installing the roll caper holder in the main printer unit at a first location when the sheet feeding device is not installed for feeding roll paper to said paper transportation path;

installing the sheet feeding device in the main printer unit at a second location different from the first location when the roll pacer holder is not installed for feeding sheet paper to said pacer transportation path;

using optical sensors for simultaneously detecting if the roll paper holder is installed to the printer when power to the printer is turned on, and at the same time detecting if the sheet feeding device is not installed to the printer, and if so;

determining if the paper transportation path is in the closed position;

detecting a leading end and a trailing end of paper in the paper transportation path; and discharging the paper from the paper transportation path when either the leading end or the trailing end of the paper is detected.

3. A control method for operating a printer comprising a main printer unit having a paper transportation path formed therein an open position to enable paper to be inserted into the paper transportation path and a closed position for preventing the insertion of paper into the paper transportation path, the printer further comprising, a roll paper holder, a sheet feeding device and connector guides for said sheet feeding device configured such that only the roll paper holder or the sheet feeding device can be installed to the main printer unit at any one time, the method comprising:

installing the roll caper holder in the main printer unit at a first location when the sheet feeding device is not installed for feeding roll paper to said paper transportation path;

installing the sheet feeding device in the main printer unit at a second location different from the first location when the roll paper holder is not installed for feeding sheet paper to said paper transportation path;

using optical sensors for simultaneously detecting if the roll paper holder is installed to the printer when power to the printer is turned on, and at the same time detecting if the sheet feeding device is not installed to the printer and if so;

determining if the paper transportation path is in the closed position;

detecting a leading end and a trailing end of paper in the paper transportation path; and indexing the paper in the paper transportation path when both the leading end and the trailing end of the paper are detected.

4. A control method for operating a printer comprising a main printer unit having a paper transportation path formed therein with an open position to enable paper to be inserted into the paper transportation path and a closed position for preventing the insertion of paper into the paper transportation path, the printer further comprising, a roll paper holder, a sheet feeding device and connector guides for said sheet feeding device configured such that only the roll paper holder or the sheet feeding device can be installed to the main printer unit at any one time, the method comprising:

installing the roll paper holder in the main printer unit at a first location when the sheet feeding device is not installed for feeding roll paper to said paper transportation path;

installing the sheet feeding device in the main printer unit at a second location different from the first location when the roll paper holder is not installed for feeding sheet paper to said paper transportation path;

using optical sensors for simultaneously detecting if the roll paper holder is installed to the printer when power to the printer is turned on, and at the same time detecting if the roll paper holder unit is not installed to the printer, and if so;

detecting if the paper transportation path is in the closed position;

detecting a leading end and a trailing end of paper in the paper transportation path before paper is supplied from the sheet feeding device; and discharging the paper from the paper transportation path when either the leading end or the trailing end of the paper is detected.

* * * * *

UNITED STATES PATENT AND TRADEMARK OFFICE

CERTIFICATE OF CORRECTION

PATENT NO. : 7,708,482 B2
APPLICATION NO. : 12/005739
DATED : May 4, 2010
INVENTOR(S) : Toshiaki Koike and Hiroshi Narita It is certified that error appears in the above-identified patent and that said Letters Patent is hereby corrected as shown below:

On the Title Page, Item (30) should read,

(30) Foreign Application Priority Data

April 21, 2003 (JP) .....2003-115655

Signed and Sealed this

Second Day of November, 2010

David J. Kappos

David J. Kappos
*Director of the United States Patent and Trademark Office*